US006840488B2

(12) United States Patent
Ngo et al.

(10) Patent No.: US 6,840,488 B2
(45) Date of Patent: Jan. 11, 2005

(54) FURNITURE SUPPORT AND CARPET PROTECTION COMBINATION, APPARATUS, KIT AND METHODS OF USING SAME

(76) Inventors: Debra K. Ngo, 435B-1FM 1092, PMB #282, Stafford, TX (US) 77477; Minh Q. Ngo, 10849 Kinghurst, Suite 100, Houston, TX (US) 77099

( * ) Notice: Subject to any disclaimer, the term of this patent is extended or adjusted under 35 U.S.C. 154(b) by 0 days.

(21) Appl. No.: 10/447,837

(22) Filed: May 29, 2003

(65) Prior Publication Data

US 2004/0238711 A1 Dec. 2, 2004

(51) Int. Cl.[7] ..... A47B 91/00
(52) U.S. Cl. ..... 248/346.11; 248/188.2
(58) Field of Search ..... 248/346.11, 188, 248/188.1, 188.2, 188.9; 16/18 R, 32

(56) References Cited

U.S. PATENT DOCUMENTS

| | | | | | |
|---|---|---|---|---|---|
| 342,970 | A | | 6/1886 | Ongley | |
| 1,559,827 | A | * | 11/1925 | Wittman | 248/346.11 |
| 2,301,385 | A | | 11/1942 | Ehrgott | |
| 2,729,019 | A | * | 1/1956 | Breeden | 248/188.9 |
| 2,902,794 | A | | 9/1959 | Ehrgott | |
| 2,944,366 | A | | 7/1960 | Joabson | |
| 3,333,805 | A | | 8/1967 | Marshall | |
| 3,357,669 | A | * | 12/1967 | D'Amato | 248/346.11 |
| 5,730,281 | A | * | 3/1998 | Powell et al. | 206/223 |
| 5,743,506 | A | | 4/1998 | Adams | |
| 5,763,039 | A | | 6/1998 | Staubs | |
| 5,823,492 | A | * | 10/1998 | Anselmo | 248/188.1 |
| 6,013,342 | A | | 1/2000 | Neto | |
| 6,119,998 | A | * | 9/2000 | Anselmo | 248/346.11 |
| D432,904 | S | | 10/2000 | Anselmo | |
| D443,200 | S | * | 6/2001 | Amburgey | D8/374 |
| 6,540,190 | B2 | * | 4/2003 | Keshavjee | 248/346.11 |
| 6,585,213 | B1 | * | 7/2003 | Olivier | 248/346.11 |

FOREIGN PATENT DOCUMENTS

| | | | |
|---|---|---|---|
| CH | 562589 A | * | 6/1975 |
| FR | 2265314 A | * | 11/1975 |
| GB | 1360471 A | * | 7/1974 |

* cited by examiner

*Primary Examiner*—Anita M. King
(74) *Attorney, Agent, or Firm*—Bracewell & Patterson, LLP

(57) ABSTRACT

A furniture support and carpet protection combination includes a piece of furniture having a furniture structural member supported by a flooring that may have irregularities and a carpet positioned between the furniture structural member and the flooring. The combination also includes a furniture support and carpet protection apparatus for supporting furniture and reducing damage to the underlying carpet. The apparatus includes a plurality of posts and a coaster having a plurality of bores to provide lateral support to the posts. The apparatus further includes a coaster cover positioned to underlie the furniture structural member and overlie the coaster to provide mount support to the furniture structural member and to distribute the weight of the furniture structural member to the plurality of posts. A kit to assemble an apparatus and a method of using an apparatus is also provided.

78 Claims, 7 Drawing Sheets

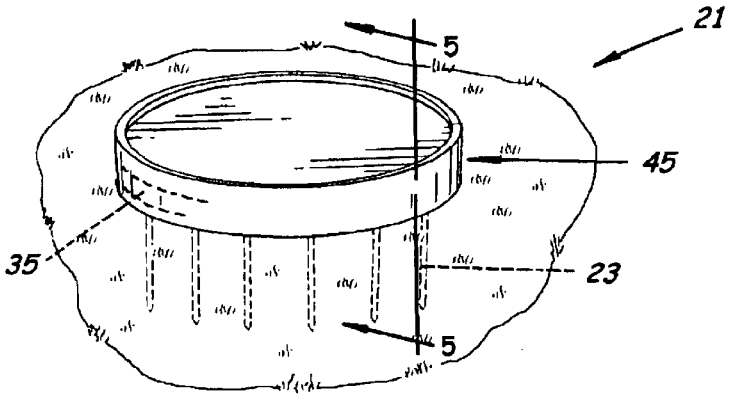
FIG. 2.
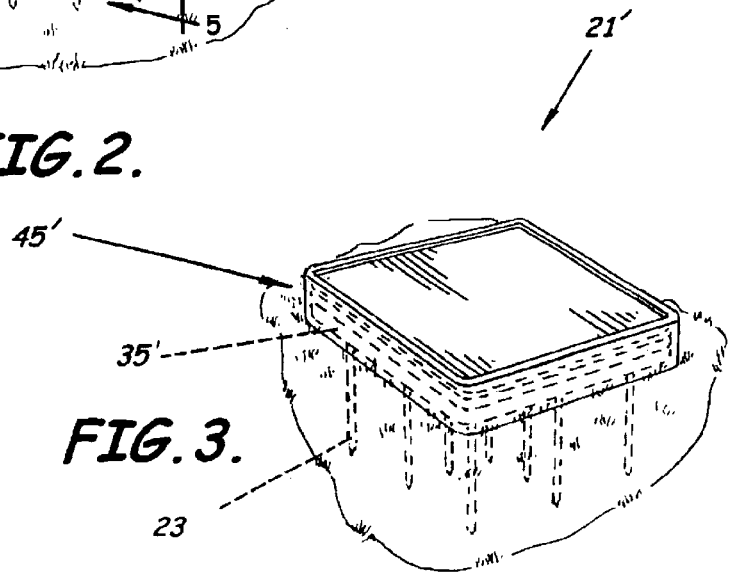
FIG. 3.
FIG. 4.
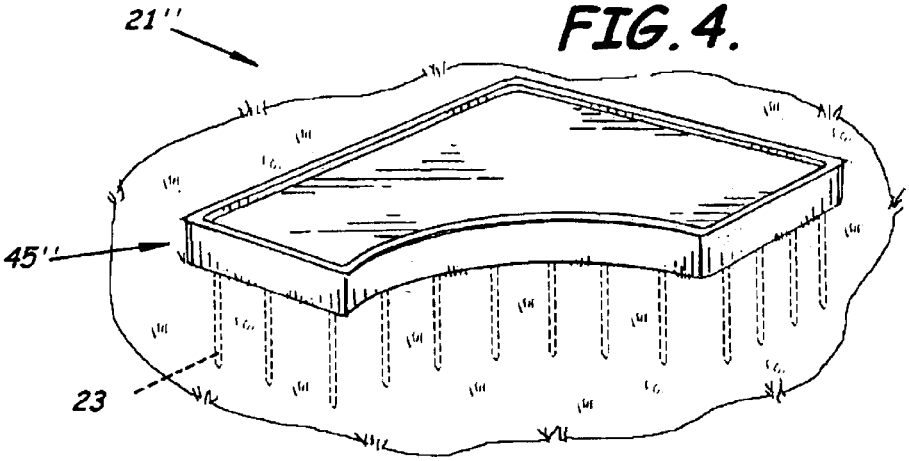

FURNITURE SUPPORT AND CARPET PROTECTION COMBINATION, APPARATUS, KIT AND METHODS OF USING SAME

BACKGROUND OF THE INVENTION

1. Field of the Invention

The present invention relates to the field of floor covering and flooring protection and, more specifically, to formation and use of floor covering and flooring protection devices. Additionally, the present invention relates to floor covering and flooring protection systems and devices that protect floor coverings from furniture type structures which may cause an imprint in the floor covering.

2. Brief Description of Related Art

Strands of fabric, typically nylon, with a surface of upright yarns are generally used to make pile in a carpet. For example, the nylon can be tufted or woven into a polypropylene primary backing to which it is bound by a predominantly latex binder applied to the underside of the backing. The pile tufted into the primary backing by itself is flexible and relatively stable, resisting buckling, wrinkling, or distortion caused by furniture. This product, however, does not have the stability, mass or tuft bind to be a carpet. It is, in essence, merely a piece of textile. Typically, integrity is added to this primary backing by the addition of a secondary backing glued to the primary backing to hold the tufts in place. The secondary backing typically takes the form of a latex binder which binds the tuft bundles protruding below the primary backing. The secondary backing adds weight, stability and durability.

A carpet pad is typically laid on a floor structure onto which a carpet is to be positioned. The carpet is horizontally positioned on this carpet pad so that the backing rests against the carpet pad whereby the carpet piles protrude vertically upward away from the backing. When furniture is placed upon the laid carpet for a period of time, the furniture has the effect of tending to crush the carpet pile, the carpet backing, and the carpet pad. The crushing effect forms indentations in this carpeting material. Once the pile gets crushed, it generally can be brushed or vacuumed to restore it nearly to its original form. When the backing gets crushed, however, it generally will not return to its original form. Also, once a pad gets crushed over a period of time, it often will not return to its original form. The crushed backing and pad typically will be visible through the carpet pile as indentations or marks. Thus, once furniture is placed on laid carpet, other than for a very short period of time, the furniture may not be able to be rearranged without leaving the indentations or marks visible on the carpet. Such extended placement of the furniture results in permanent damage to the carpet. The only recourse may be to either replace the carpet and carpet pad or position other furniture or coverings over the indentations. Replacement of the carpet and carpet pad is generally not feasible unless something is done to prevent destruction of the new carpet by the furniture, as described above.

Prior furniture supports or carpet protectors have been constructed to attempt to solve this problem. Some of these early devices included pedestals or bases generally formed of a single homogeneous material such as glass, rubber, plastic, or the like placed under the legs or support structure of the furniture in an attempt to distribute the furniture load over a given area of floor material. Other similar devices included furniture caps or coasters developed in an attempt to protect carpet pile also by distributing the load caused by a particular piece of furniture over a larger area. These devices were unable to solve the problem, as after a long period of time, a depression or indentation would nevertheless result. These caps, plates, pedestals, or coasters merely made larger residual marks in the carpet backing and carpet pad.

Later devices, especially with respect to legged furniture, included a form of plate or cup generally shaped at the upper surface to receive the bottom of the furniture leg or support structure. The lower surface of the plate or cup typically included pegs or posts with a length greater than the thickness of the pile of the particular carpet so that when the tips of the pegs or posts were brought into load-bearing engagement with the weave or backing of the carpet, the lower surface of the plate or cup did not bear on the surface of the pile, but rather was elevated thereabove. The tips of the pegs or posts were sufficiently small enough to divide and pass between the pile fibers without tending to tuck the fibers beneath the pile surface but small enough that the tips would pierce the woven backing under the weight of the furniture. The pegs or posts, however, did not pierce through the backing material of the carpet or the carpet pad. Though marginally successful in causing a somewhat waffle-shaped indentation which was more readily masked by brushing or vacuuming the pile if the furniture was frequently moved, the ultimate result was still a crushing of the carpet and especially of the carpet pad.

Some subsequent devices, especially with respect to legged furniture, also included a plate of sufficient size to receive a bottom structural member of piece of furniture. The lower surface of the plate of this device included pins of a sufficient length to pierce the carpet backing and the carpet pad so as to engage a flat floor surface or a flat protective surface placed under the carpet material. This device, however, was limited as it had insufficient ability to compensate for irregularities on the floor surface. This inability typically frequently resulted in unstable upper surface support of the furniture structure, and instability resulting in a weakened structural integrity regarding the pins or posts.

Further, problems with the flooring that support the carpet are not always due to minor irregularities in the flooring surface. For example, carpeted flooring, by its nature often includes a conventional carpet tack strip surrounding the perimeter of the carpeting. The carpet tack strip generally consists of an elongated strip of wood, whereby a series of relatively short nails or tacks are driven through the strip such that the head of each tack is flush with the underside of the strip, and the point of each tack extends above the upper surface of the strip. When laying carpet on a floor, the strips are nailed, stapled or otherwise secured to the floor adjacent the edges of the room in which the carpet is being laid. The carpet pad is cut and placed such that its edge is located adjacent to the outer edge of the strip, and the carpet is laid over the pad and strip and retained in place by the upwardly facing points of the tacks.

Earlier devices were not designed to deal with this carpet tack strip. If the furniture support or carpet protector device of the prior art was partially laid over the carpet tack strip, the result would be an unstable placement of the furniture, which would become increasingly unstable as the carpet and carpet pad further compressed due to the weight of the furniture. Thus, furniture utilizing any one of the above mentioned earlier devices had to be spaced sufficiently from the edge of the room so that the device would not engage the carpet tack strip.

Accordingly, it can be appreciated that there still exists a need for a furniture support and carpet protector device and methods of a sufficient strength to support the weight of the furniture when placed on a somewhat irregular surface and which can be adjusted manually or automatically to compensate for the weight of the furniture and irregularity of the surface while providing a minimal detrimental effect on the carpet or carpet pad.

SUMMARY OF THE INVENTION

In view of the foregoing, an embodiment of the present invention advantageously provides a furniture support and carpet protection apparatus which minimizes damage to a carpet or carpet pad in the form of indentations caused by the weight of furniture placed on the carpet or carpet pad for a prolonged period of time. An embodiment of the present invention also advantageously can compensate for irregularities in the floor surface which would tend to cause instability to supported furniture. An embodiment of the present invention additionally provides for manual sizing of posts for both placement with the proper carpet and or carpet pad depth and irregularities in the flooring support surface. An embodiment of the present invention still also provides a furniture support and carpet protection apparatus that is aesthetically pleasing and can either blend in with or match the decor of the furniture it is supporting or the carpet it is protecting. An embodiment of the present invention further advantageously provides a system and method of using the furniture support and carpet protection apparatus. An embodiment of the present invention also provides a kit that enhances assembly of a protection device and compensation for flooring irregularities.

Note, the term "carpet" as used herein refers to various types of floor coverings including but not limited to wall-to-wall carpeting, area rugs, and throw rugs generally made from either natural material such as, for example, wool and cotton, or synthetic material such as, for example, nylon and acrylic. The term "carpet" as used also may include a carpet pad. The term "furniture" as used herein refers to various types of structures which may be placed upon a floor covering or flooring, for example, tables, chairs, beds, appliances, computers, file cabinets, televisions, storage bins, and bookshelves.

More particularly, an embodiment of the present invention provides a furniture support and carpet protection apparatus for supporting furniture and reducing damage to an underlying carpet which includes a plurality of posts each having a shaft of a pre-selected length and having a first end and a second end. The first end of the shaft defines a proximal head of the post and the second end of the shaft defines a distal tip of the post. The distal tip of the post is shaped to penetrate the carpet when under the weight of a furniture structural member. The carpet protection apparatus further includes a coaster having a coaster body, an upper surface, a lower surface, and a plurality of bores extending through the coaster body from the upper surface to the lower surface. At least three of the plurality of bores has one of the plurality of posts positioned therein. Also, each of the plurality of bores extends through the coaster body to provide radial support to the shaft of each post positioned therein. The carpet protection apparatus further includes a coaster cover having a coaster cover body, an upper surface positioned to underlie the furniture structural member, and a lower surface overlying the coaster. The coaster cover provides mount support to the furniture structural member when positioned to overlie the carpet so that the coaster cover distributes the weight of the furniture structural member to the proximal head of each of the plurality of posts.

In an embodiment of the present invention, the carpet protection apparatus can also include a coaster cover upper mattress positioned between the upper surface of the coaster cover and the furniture structural member to provide a cushioned surface for the furniture structural member and to restrict lateral movement of the furniture structural member with respect to the coaster cover. The plurality of posts of the carpet protector apparatus also can be slidably positioned within the plurality of bores to allow individual longitudinal displacement of the plurality of shafts of the plurality of posts to compensate for irregularities in flooring underlying the carpet. In this embodiment, each proximal head of a plurality of posts can have a radial extension extending radially and outwardly from upper end portions of the shaft to define a post head radial extension. At least one of the post head radial extensions can slidably engage the upper surface of the coaster to stop the proximal head of the post from extending into the bore of the coaster.

Additionally, an embodiment of the apparatus can further include a coaster cover lower mattress positioned between the upper surface of the coaster and the lower surface of the coaster cover, abuttingly contacting each proximal head of the plurality of posts, and being compressible by the weight of the furniture structural member when positioned on the coaster cover. The effect of the lower mattress is to further compensate for differing longitudinal positions of the proximal heads of the plurality of posts when sliding through the plurality of bores of the coaster. The coaster cover lower mattress further aids in restricting lateral displacement of the coaster cover with respect to the coaster. In an embodiment, the coaster cover lower mattress also provides a cushioned interface for the lower surface of the coaster cover.

In another embodiment of the present invention, the carpet protector apparatus includes a coaster cover plate having an upper surface underlying the coaster cover and a lower surface overlying the coaster. The coaster cover plate provides structural protection to the coaster cover from the plurality of posts. In this embodiment, a plurality of the proximal heads of the plurality of posts can abut the lower surface of the coaster cover plate. The coaster cover plate structure stops the plurality of posts from extending out of the plurality of the bores of the coaster. The coaster cover plate can be slidably connected to and positioned adjacent the upper surface of the coaster, abuttingly contacting at least two proximal heads of the plurality of posts to further compensate for differing longitudinal positions of the proximal heads of the plurality of posts when sliding through the plurality of bores of the coaster.

In an embodiment, the coaster cover plate includes a first mattress positioned between the upper surface of the coaster and the lower surface of the coaster cover plate. The first mattress abuttingly contacts each proximal head of the plurality of posts. The first mattress is compressible by the weight of the furniture structural member. In this configuration, the coaster cover plate allows for differing longitudinal positions of the proximal heads of the plurality of posts with respect to the upper surface of the coaster when sliding through the plurality of bores of the coaster. In an embodiment of the present invention, the coaster cover plate further includes a second mattress affixed to the upper surface of the coaster cover plate to provide a cushioned surface for the furniture structural member and to restrict lateral movement of the furniture structural member with respect to the coaster cover. In an alternative embodiment, at least one of the coaster covers and the coaster cover plate includes magnetic material and at least one of the coaster covers and the coaster cover plate includes magnetically responsive material to restrict movement of the coaster cover with respect to the coaster.

In an embodiment of the present invention, either the coaster body of the coaster or the coaster cover body of the coaster cover has an annular flange protruding outwardly from peripheries thereof to restrict lateral displacement of the coaster cover with respect to the coaster and restrict lateral displacement of the furniture structural support with respect to the coaster.

Advantageously, in an embodiment of the present invention, at least two of the shafts of the plurality of posts positioned in the plurality of pre-selected bores of the coaster can have different longitudinal lengths to further compensate for irregularities in the flooring such as by positioning one or more shafts having a shorter length in portions of a floor more raised than other portions.

An embodiment of an apparatus of the present invention is generally described in a form where the carpet preferably overlies the flooring that is not easily damaged by the distal tips of the posts. In an embodiment, each of the distal tips of the plurality of posts is shaped to extend through the carpet and to contact the upper surface of flooring. In an alternative embodiment, primarily designed for area-type rugs, the carpet protection apparatus can further include a floor plate positioned to underlie the carpet and to overlie the flooring to support the distal tips of the plurality of posts when under the weight of the furniture structural member. This floor plate advantageously further reduces damage to the flooring.

In an embodiment where the configuration of the coaster cover is non-annular, the coaster cover of the carpet protector apparatus further includes a plurality of sides forming a lateral periphery substantially perpendicular to the furniture structural member. In this embodiment, at least one of the plurality of sides includes a flange protruding outwardly from at least one of the sides and positioned to restrict lateral displacement of the furniture structural support with respect to the coaster cover.

An embodiment of the present invention also provides a furniture support and carpet protection combination which includes a piece of furniture having a furniture structural member supported by a flooring having irregularities, a carpet positioned between the furniture structural member and the flooring, and a furniture support and carpet protection apparatus positioned between the furniture structural member and the flooring and overlying the carpet for supporting furniture and reducing damage to the underlying carpet. The apparatus includes a plurality of posts each having a shaft of a pre-selected length and having a first end and a second end. The first end of the shaft defines a proximal head of the post and the second end of the shaft defines a distal tip of the post. The distal tip of the post is shaped to penetrate the carpet when under the weight of a furniture structural member. The carpet protection apparatus further includes a coaster having a coaster body, an upper surface, a lower surface, and a plurality of bores extending through the coaster body from the upper surface to the lower surface. At least three of the plurality of bores has one of the plurality of posts positioned therein. Also, each of the plurality of bores extends through the coaster body to provide radial support to the shaft of each post positioned therein. The carpet protection apparatus further includes a coaster cover having a coaster cover body, an upper surface positioned to underlie the furniture structural member, and a lower surface overlying the coaster. The coaster cover provides mount support to the furniture structural member when positioned to overlie the carpet so that the coaster cover distributes the weight of the furniture structural member to the proximal head of each of the plurality of posts. Various embodiments of the furniture support and carpet protection apparatus exist, some of which were highlighted above and will be described in detail below.

An embodiment of the present invention further provides a kit for supporting furniture and reducing damage to an underlying carpet and methods of using the furniture support and carpet protection apparatus. The kit includes a container, and a plurality of posts positioned in the container. Each of the plurality of posts includes a shaft of a pre-selected length and has a first end and a second end. The first end of the shaft defines a proximal head of the post and the second end of the shaft defines a distal tip of the post shaped to penetrate the carpet when under the weight of a furniture structural member. The kit also includes a coaster positioned in the container and adapted to be positioned under the furniture structural member. The coaster has a coaster body, an upper surface, a lower surface, and a plurality of bores extending through the coaster body from the upper surface to the lower surface. Each of the plurality of bores is adapted to have one of the plurality of posts positioned therein and extend through the bore to provide radial support to the shaft of the post. The kit also includes a coaster cover positioned in the container. The coaster cover has a coaster cover body, an upper surface adapted to be positioned to underlie the furniture structural member, and a lower surface adapted to be positioned to overlie the coaster. The coaster cover provides mount support to the furniture structural member when positioned to overlie the carpet so that the coaster cover distributes the weight of the furniture structural member to the proximal head of each of the plurality of posts.

In an embodiment of the present invention, the kit can further include a coaster cover upper mattress positioned in the container and adapted to be positioned between the upper surface of the coaster cover and the furniture structural member to provide a cushioned surface for the furniture structural member and to restrict lateral movement of the furniture structural member with respect to the coaster cover. The plurality of posts are further adapted to be slidably positioned within the plurality of bores to allow individual longitudinal displacement of the plurality of shafts of the plurality of posts in order to compensate for irregularities in flooring underlying the carpet. In this embodiment, each proximal head of a plurality of posts preferably has a radial extension extending radially and outwardly from upper end portions of the shaft to define a post head radial extension. At least one of the post head radial extensions to slidably engage the upper surface of the coaster to stop the proximal head of the post from extending into the bore of the coaster, when positioned therein.

In another embodiment of a kit of the present invention, the kit includes a coaster cover plate positioned in the container and having an upper surface adapted to underlie the coaster cover and have a lower surface overlying the coaster to provide structural protection to the coaster cover from the plurality of posts. A plurality of the proximal heads of the plurality of posts are adapted to abut the lower surface of the coaster cover plate to stop the plurality of posts from extending out of the plurality of bores of the coaster. The coaster cover plate structure stops the plurality of posts from extending out of plurality of the bores of the coaster when positioned therein. The coaster cover plate is adapted to be slidably connected to and positioned adjacent the upper surface of the coaster. When so positioned, the coaster cover plate abuttingly contacts at least two proximal heads of the plurality of posts to further compensate for differing longitudinal positions of the proximal heads of the plurality of posts when sliding through the plurality of bores of the coaster.

In an embodiment of the present invention, the coaster cover plate includes a first mattress adapted to be positioned between the upper surface of the coaster and the lower surface of the coaster cover plate. When so positioned, the first mattress abuttingly contacts each proximal head of the plurality of posts and is compressible by the weight of the furniture structural member. When positioned in conjunction with the first mattress, the coaster cover plate allows for differing longitudinal positions of the proximal heads of the plurality of posts with respect to the upper surface of the coaster when the posts are sliding through the plurality of bores of the coaster. In an embodiment, the coaster cover plate further includes a second mattress attached to the upper surface of the coaster cover plate to provide a cushioned surface for the furniture structural member and to restrict lateral movement of the furniture structural member with respect to the coaster cover. In an alternative embodiment, at least one of the coaster cover and the coaster cover plate includes magnetic material and at least one of the coaster cover and the coaster cover plate includes magnetically responsive material to restrict movement of the coaster cover with respect to the coaster.

In an embodiment of the present invention, either the coaster body of the coaster or the coaster cover body of the coaster cover can has an annular flange protruding outwardly from peripheries thereof. The flange functions to restrict lateral displacement of the coaster cover with respect to the coaster and restrict lateral displacement of the furniture structural support with respect to the coaster when the coaster and coaster cover are positioned together under the furniture structural support. Advantageously at least two of the shafts of the plurality of posts can have different longitudinal lengths and are adapted to be positioned in the plurality of pre-selected bores of the coaster to compensate for irregularities in the flooring.

An embodiment of a method of using a furniture support and carpet protection apparatus for supporting furniture and reducing damage to a carpet includes positioning a coaster on a selected piece of carpet. The coaster has a coaster body, an upper surface, a lower surface, and a plurality of bores extending through the coaster body from the upper surface to the lower surface. The method also includes positioning a pre-selected number of the plurality of posts through the plurality of bores in the coaster. The length of each of the posts can be selected dependent upon the combined height of a carpet and any irregularities. The irregularities include deviations as small as blemishes to ones as large as or larger than and including a carpet tack strip. The method can also include connecting a coaster cover plate to the coaster adjacent the upper surface of the coaster, and placing the coaster cover plate in abutting contact with at least two proximal heads of the plurality of posts. This is accomplished to further compensate for differing longitudinal positions of the proximal heads of the plurality of posts when sliding through the plurality of bores of the coaster.

In another embodiment of a method of using a furniture support and carpet protection apparatus for supporting furniture and reducing damage to a carpet, a method includes positioning a coaster on a selected piece of carpet. The coaster has a coaster body, an upper surface, a lower surface, and a plurality of bores extending through the coaster body from the upper surface to the lower surface. The method also includes positioning a pre-selected number of the plurality of posts through the plurality of bores in the coaster. The length of each of the posts can be selected dependent upon the combined height of a carpet and any irregularities. The irregularities include deviations as small as blemishes to ones as large as or larger than and including a carpet tack strip. The method also includes positioning a coaster cover adjacent the upper surface of the coaster, and placing at least one of the coaster cover and coaster cover lower mattress in abutting contact with at least two proximal heads of the plurality of posts. This is accomplished to further compensate for differing longitudinal positions of the proximal heads of the plurality of posts when sliding through the plurality of bores of the coaster.

In another embodiment of a method of using a furniture support and carpet protection apparatus for supporting furniture and reducing damage to a carpet, a method includes positioning a coaster on a selected piece of carpet. The coaster has a coaster body, an upper surface, a lower surface, and a plurality of bores extending through the coaster body from the upper surface to the lower surface. The method also includes positioning a plurality of posts through the plurality of bores in the coaster. Each of the plurality of posts has a shaft of a preferably pre-selected length, a proximal head, and a distal tip. The number of posts that are positioned through the bores are dependent upon a weight bearing load carried by a furniture structural member. The length of each of the posts positioned through the bores are selected dependent upon the combined height of a carpet. The method also includes covering the coaster and the plurality of posts with a coaster cover having an upper surface and a lower surface. The coaster cover provides mount support to the furniture structural member when positioned to overlie the carpet. The method also includes positioning the furniture structural member atop the upper surface of the coaster cover.

In an embodiment, the method also includes the step of connecting a coaster cover plate to the coaster adjacent the upper surface of the coaster, and placing the coaster cover plate in contact with at least two proximal heads of the plurality of posts. This is to further compensate for differing longitudinal positions of the proximal heads of the plurality of posts when sliding through the plurality of bores of the coaster. In an embodiment, the method further includes selectively adjusting the length of a subset of posts of the plurality of posts positioned between the coaster and a coaster cover, to compensate for an irregularity greater than at minimum the thickness of a coaster cover lower mattress.

BRIEF DESCRIPTION OF THE DRAWINGS

Some of the features, advantages, and benefits of the present inventions, having been stated, others will become apparent as the description proceeds when taken in conjunction with the accompanying drawings in which:

FIG. 2 is a perspective view of a furniture support and carpet protection apparatus positioned on flooring according to an embodiment of the present invention;

FIG. 3 is a perspective view of a furniture support and carpet protection apparatus positioned on flooring according to another embodiment of the present invention;

FIG. 4 is a perspective view of a furniture support and carpet protection apparatus positioned on flooring according to yet another embodiment of the present invention;

DETAILED DESCRIPTION

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Note, the term "carpet" as used herein refers to various types of floor coverings including but not limited to wall-to-wall carpeting, area rugs, and throw rugs generally made from either natural material such as, for example, wool and cotton, or synthetic material such as, for example, nylon and acrylic. The term "carpet" as used also may include a carpet pad. The term "furniture" as used herein refers to various types of structures which may be placed upon a floor covering or flooring, for example, tables, chairs, beds, appliances, computers, file cabinets, televisions, storage bins, and bookshelves.

The present invention, as perhaps best illustrated in FIGS. 1–12, advantageously provides a furniture support and carpet protection combination 20 for supporting furniture and reducing damage to an underlying carpet. As perhaps best shown in FIG. 1, the combination 20 includes a piece of furniture having a furniture structural support or member 33 supported by a flooring 55 having irregularities. The combination 20 also includes a carpet 22 positioned between the furniture structural member 33 and the flooring 55. As shown in FIGS. 2–4, the combination 20 also includes a furniture support and carpet protection apparatus for supporting furniture and reducing damage to the underlying carpet 22. The apparatus (e.g. 21, 21', and 21") preferably features various geometric shapes pre-selected to most appropriately coincide with the shape of the furniture structural member 33.

Figure 1:
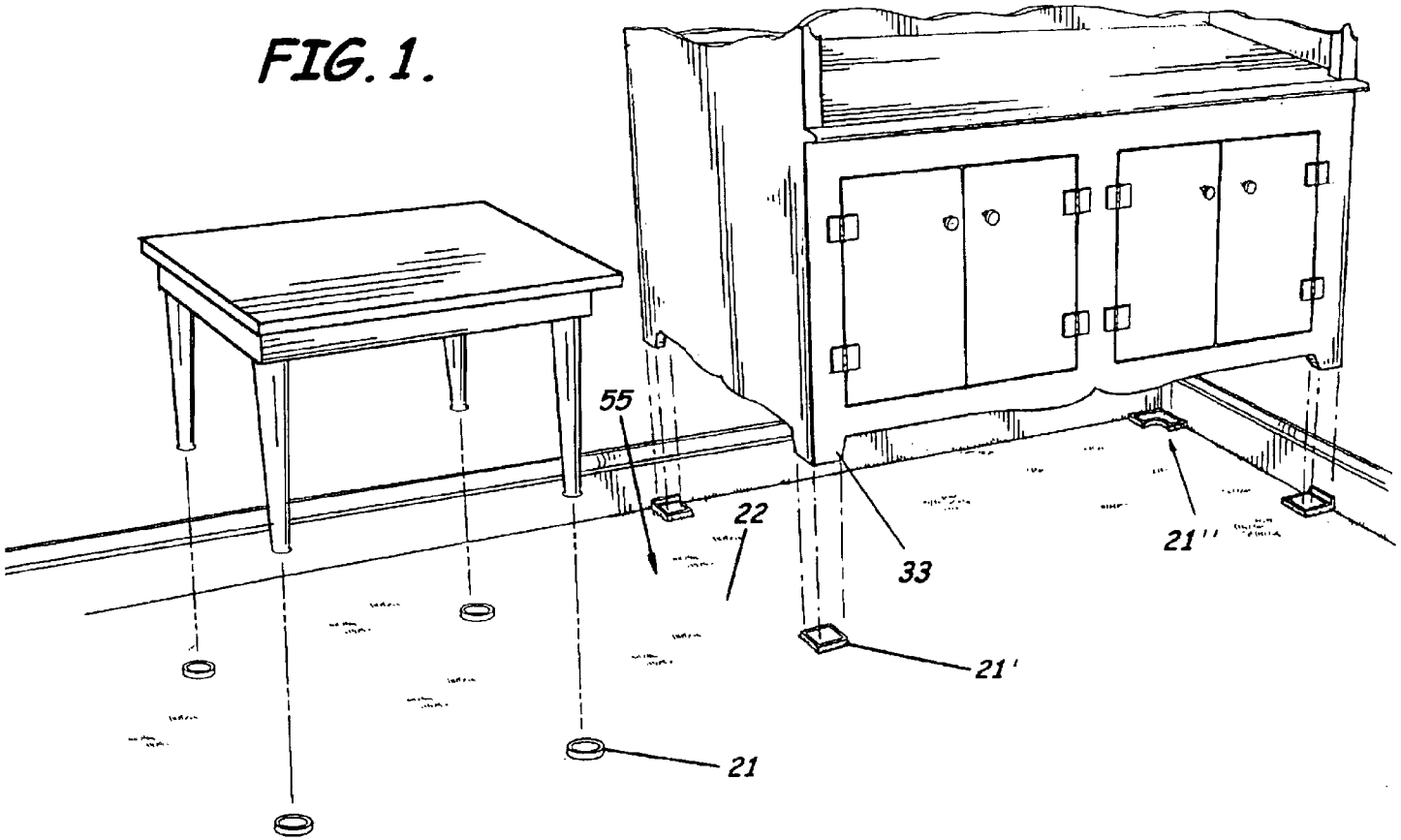
FIG. 1 is a environmental perspective view of a plurality of embodiments of a furniture support and carpet protection combination according to the present invention.
Figure 5:
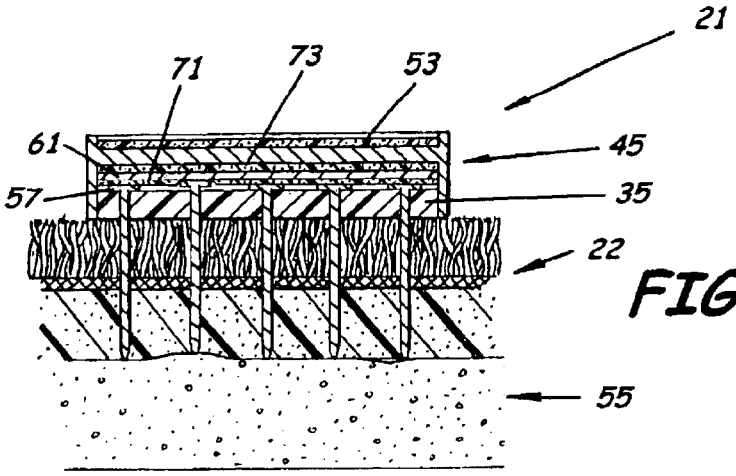
FIG. 5 is a sectional view of a furniture support and carpet protection apparatus taken along the 5—5 line of FIG. 2 according to an embodiment of the present invention.
Figure 6:
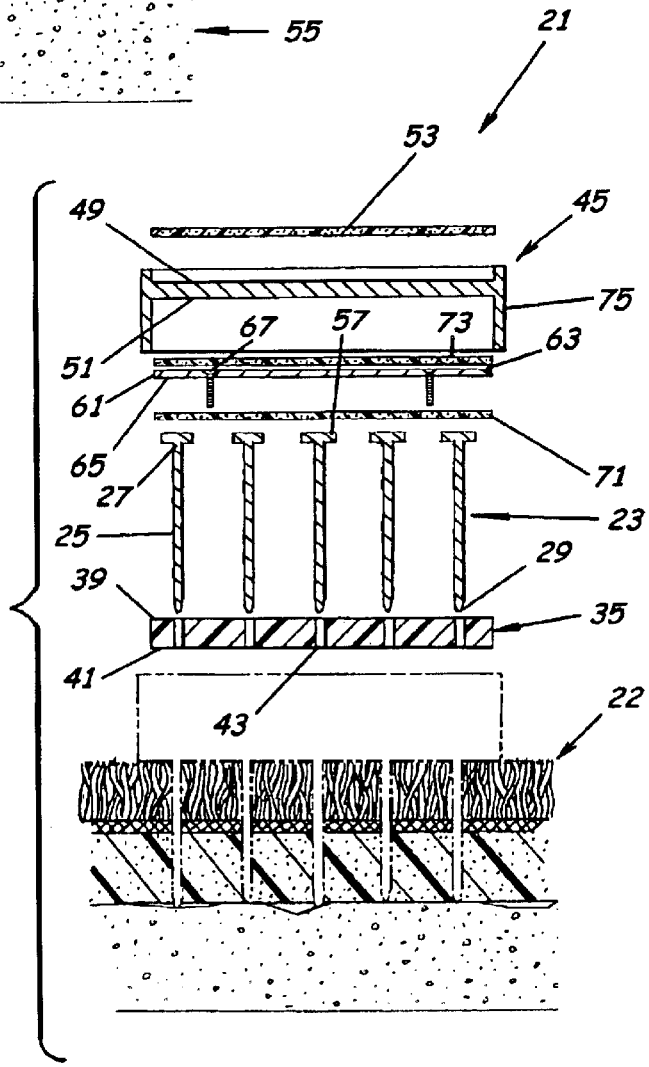
FIG. 6 is a exploded sectional view of a furniture support and carpet protection apparatus of FIG. 5 according to an embodiment of the present invention.

As shown in FIGS. 5–6, the carpet protection apparatus 21 includes a plurality of posts 23 each having a shaft 25 of a pre-selected length and having a first end and a second end. The first end of the shaft defines a proximal head 27 of the post and the second end of the shaft defines a distal tip 29 of the post 23. The distal tip 29 of the post 23 is shaped to penetrate the carpet 22 when under the weight of a furniture structural member 33 (FIG. 1). The posts 23 typically range in length from between approximately ¼ inch and 1¼ inches depending on the thickness of the carpet 22 and can be formed of stainless steel or other rust resistant material, as known by those skilled in the art. The carpet protection apparatus 21 further includes a coaster 35 having a coaster body, an upper surface 39, a lower surface 41, and a plurality of bores 43 extending through the coaster body from the upper surface 39 to the lower surface 41. Preferably, at least three of the plurality of bores 43 has one of the plurality of posts 23 positioned therein. Each of the plurality of bores 43 extend through the coaster body to provide radial support to the shaft 25 of each post 23 positioned therein. The coaster 35 can be formed of stainless steel, hard plastic, or the like, to provide the required radial support. The typical longitudinal height of the coaster 35 may be approximately ¼ inch.

The carpet protection apparatus 21 further includes a coaster cover 45 having a coaster cover body, an upper surface 49 positioned to underlie the furniture structural member 33, and a lower surface 51 overlying the coaster 35. The coaster cover 45 provides mount support to the furniture structural member 33 when positioned to overlie the carpet 22 so that the coaster cover 45 distributes the weight of the furniture structural member 33 to the proximal head 27 of each of the plurality of posts 23. Typically, the combined longitudinal height of the coaster cover 45 overlaying the coaster 35 is typically ½ inch.

In an embodiment of the present invention, the carpet protection apparatus 21 can also include a coaster cover upper mattress 53 positioned between the upper surface 49 of the coaster cover 45 and the furniture structural member 33 (FIG. 1) to provide a cushioned surface for the furniture structural member 33 and to restrict lateral movement of the furniture structural member 33 with respect to the coaster cover 45. The plurality of posts 23 of the carpet protector apparatus 21 also can be slidably positioned within the plurality of bores 43 to allow individual longitudinal displacement of the plurality of shafts 25 of the plurality of posts 23 to compensate for irregularities in flooring 55 underlying the carpet 22. Structurally, the furniture structural member 33 (FIG. 1) sits atop the coaster cover 45 which sits atop the plurality of posts 23 which sits atop a flooring 55 and which are laterally supported in a substantially vertical position by a coaster 35. The slidability of the posts 23 within bores 43 allows for the compensation of irregularities by allowing the individual posts 23 to be positioned in differing vertical altitudes dependent upon the differing vertical altitudes of the flooring directly below the distal tips 29 of the posts 23.

In this embodiment, each proximal head 27 of a plurality of posts 23 can have a radial extension extending radially and outwardly from upper end portions of the shaft 25 to define a post head radial extension 57. At least one of the post head radial extensions 57 can slidably engage the upper surface of the coaster 35 to stop the proximal head 27 of the post 23 from extending into the bore 43 of the coaster 35. The size of the post head radial extension 57 is preferably sufficient to prevent the head 27 of the post 23 from even partially entering the bore 43. The size of the radial extension 57 also can aid in the distribution of weight translated from the furniture structural member 33 to the posts 23. The size of the radial extension 57 can also aid in preventing damage to the coaster cover 45 or any cushioning material therebetween as described below. In an embodiment of the present invention, the coaster 35 is of a sufficient longitudinal length to provide sufficient structural support to the plurality of posts 23 such that shaft 25 of each of the plurality of posts 23 may have substantially the same diameter throughout the longitudinal extent between the proximal head 27 and the distal tip 29.

In another embodiment of the present invention, as perhaps best shown in FIG. 7, the apparatus 21, typically in a configuration similar to that described above (FIGS. 5–6) and having no coaster cover plate 61 (embodiment described below), further comprises a coaster cover lower mattress 59 positioned between the upper surface 39 of the coaster 35 and the lower surface 51 of the coaster cover 45. In this configuration, the lower mattress 59 can be positioned to abuttingly contact each proximal head 27 of the plurality of posts 23. Additionally, the lower mattress 59 is compressible by the weight of the furniture structural member 33 when positioned on the coaster cover 45. The effect of the lower mattress 59 is to further compensate for differing longitudinal positions of the proximal heads 27 of the plurality of posts 23 when sliding through the plurality of bores 43 of the coaster 35. The coaster cover lower mattress 59 can aid in restricting lateral displacement of the coaster cover 45 with respect to the coaster 35. In this embodiment, the coaster cover lower mattress 59 is positioned to also provide a cushioned interface for the lower surface 51 of the coaster cover 45, depending on the material selected. Typically, the mattress is formed of rubber or other elastic material as known by those skilled in the art.

In another embodiment of the present invention, as perhaps best shown in FIGS. 5–6, the carpet protector apparatus 21 further comprises a coaster cover plate 61 having an upper surface 63 underling the coaster cover 45 and a lower surface 65 overlying the coaster 35. The coaster cover plate 61 can provide structural protection to the coaster cover 45 from the plurality of posts 23. Without the coaster cover plate 61, the proximal heads 27 of the posts 23 may have the tendency to penetrate the lower side 51 of the coaster cover 45. In this embodiment, a plurality of the proximal heads 27 of the plurality of posts 23 directly or indirectly abut the lower surface 65 of the coaster cover plate 61 instead of the lower surface of the coaster cover 45 or coaster cover mattress 59 (FIG. 7). Functionally, the coaster cover plate structure stops the plurality of posts 23 from extending out of the plurality of the bores 43 of the coaster 35.

In another embodiment of the present invention, the coaster cover plate 61 is slidably connected to and positioned adjacent the upper surface 39 of the coaster 35. The coaster cover plate 61, either directly or indirectly, abuttingly contacts at least two proximal heads 27 of the plurality of posts 23 to further compensate for differing longitudinal positions of the proximal heads 27 of the plurality of posts 23 when the posts 23 slide through the plurality of bores 43 of the coaster 35. One method of accomplishing the slidability feature is to connect the coaster cover plate 61 to the coaster 35 using an at least one attachment device 67, for example, a coaster cover plate screw. Though there are numerous attachment devices available, as known by those skilled in the art and still within the scope of the present invention, the typical configuration, and the one shown in FIGS. 5–6 include at least two coaster cover plate screws spaced apart and threaded into the coaster 35. To provide for slidability, the screws can be deliberately left loose, partially extending above the lowest portion of the upper surface 63 of the coaster cover plate 61, in order to allow vertical displacement of the coaster cover plate 61. Thus, as the posts 23 would tend to slide outwardly through the bores 43 due to irregularities in the flooring 55, the coaster cover plate 61 provides minimal restriction until the portion of the upper surface 63 of the coaster cover plate 61 beneath the engagement portion of the attachment device 67 contacts an engagement portion of the attachment device 67. For example, as a post 23 would extend upwardly due to an irregularity in the flooring 55, the coaster cover plate 61 would extend upwardly until contacting the lower surface of the screwheads. The coaster cover plate 61 and coaster 35 may include prefabricated bores or recesses to accommodate the attachment device 67, which may or may not be prethreaded. Alternatively, the bores or recesses necessary to accommodate the attachment device 67 may be formed at the instant the coaster cover plate 61 is being attached to the coaster 35 by attachment device 67.

In an embodiment of the present invention, the coaster cover plate 61 includes a first mattress 71 positioned between the upper surface 39 of the coaster 35 and the lower surface 65 of the coaster cover plate 61. The first mattress 71 is functionally similar to the coaster cover lower mattress 59, described above, and may be interchangeable with the coaster cover lower mattress 59 if implemented in a configuration where the first mattress 71 is not physically attached to the coaster cover plate 61. In the preferred configuration, the first mattress 71 abuttingly contacts each proximal head 27 of the plurality of posts 23, and contacts the lower surface 65 of the coaster cover plate 61. The first mattress 71 is compressible by the weight of the furniture structural member 33. In this configuration, through use of the compressibility of the first mattress 71, the coaster 35 allows for differing longitudinal positions of the proximal heads 27 of the plurality of posts 23 with respect to the upper surface 39 of the coaster 35 when sliding through the plurality of bores 43 of the coaster 35. The first mattress 71 performs this compressibility function even if the attachment device 67 does not provide the coaster cover plate 61 with independent slidability. If independent slidability is provided, however, the first mattress 71 provides a synergistic effect in dealing with flooring irregularities. Note, in the configuration where the first mattress 71 is attached to the coaster cover plate 61, use of an adhesive, as known by those skilled in the art, is preferable, however various other attachment methodologies may be employed and still be within the scope of the present invention.

In an embodiment of the present invention, the coaster cover plate 61 further includes a second mattress 73 preferably attached to the upper surface 63 of the coaster cover plate 61 to provide a cushioned interface for the furniture structural member 33 and to restrict lateral movement of the furniture structural member 33 with respect to the coaster cover 45. If the coaster cover 45 is used, the second mattress 73 also helps restrict lateral movement of the coaster cover 45 and, depending on the configuration of material used, provides a cushioned surface for the coaster cover 45. In an alternative embodiment of the present invention, at least one of the coaster cover 45 and the coaster cover plate 61 includes magnetic material and at least one of the coaster cover 45 and the coaster cover plate 61 includes magnetically responsive material to restrict movement of the coaster cover 45 with respect to the coaster 35. The use of the magnetic attachment between the coaster cover 45 and the coaster 35 can prevent the coaster cover 45 from being inadvertently dislodged from the proper position both during setup and while the user is manipulating the furniture being supported.

As perhaps best shown in FIG. 6, in the preferred embodiment of the present invention, the coaster cover 45 further has an annular flange 75 positioned to substantially surround the coaster cover 45 to provide stable positioning of the furniture support and carpet protection apparatus 21 between the furniture structural member 33 and the floor 55. The implementation of the annular flange 75 may be either from the body of the coaster cover 45, as described above, or from the body of the coaster 35 and still be within the scope of the invention. The annular flange 75 preferably functions to restrict lateral displacement of the furniture structural support 33 with respect to the coaster cover 45, and preferably functions to restrict lateral displacement of the coaster cover 45 with respect to the coaster 35, depending upon the implementation. If the annular flange 75 is implemented to protrude outwardly from upper periphery of the body of the coaster cover 45, or to protrude outwardly from the upper periphery of the body of the coaster 35 a distance exceeding the combined thickness of the coaster cover 45 and any structures in between, the flange 75 should help restrict lateral displacement of the furniture structural support 33. If the annular flange 75 is implemented to protrude outwardly from the lower periphery of the body of the coaster cover 45 or the upper periphery of the body of the coaster 35, the flange 75 can help restrict lateral displacement of the coaster cover 45 with respect to the coaster 35.

Figure 7:
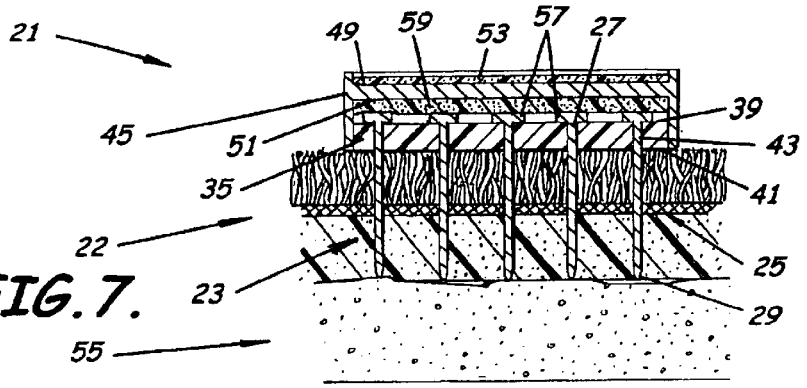
FIG. 7 is a sectional view of a furniture support and carpet protection apparatus of according to yet another embodiment of the present invention.
Figure 8:
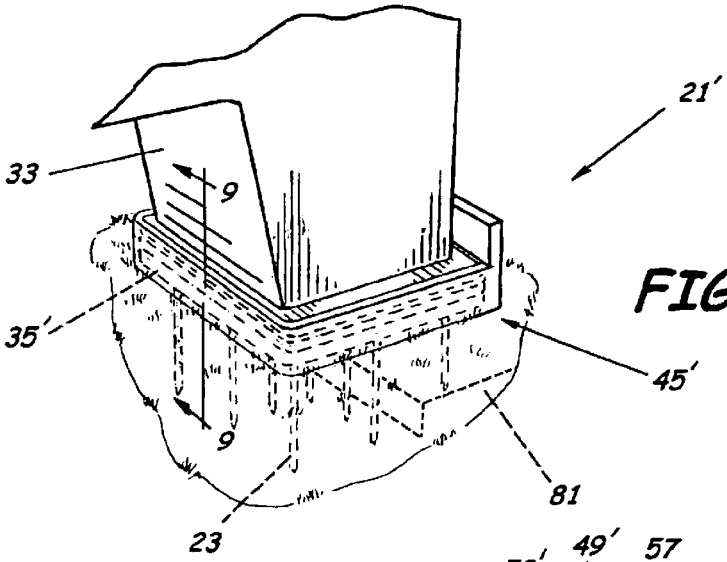
FIG. 8 is perspective view of a furniture support and carpet protection apparatus positioned on uneven flooring according to still another embodiment of the present invention.
Figure 9:
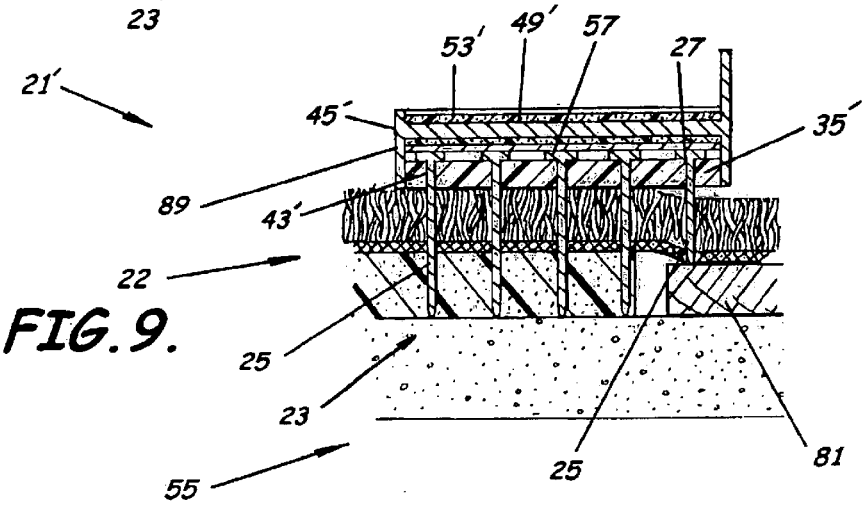
FIG. 9 a sectional view of a furniture support and carpet protection apparatus taken along the 9—9 line of FIG. 8 according to an embodiment of the present invention.
Figure 10:
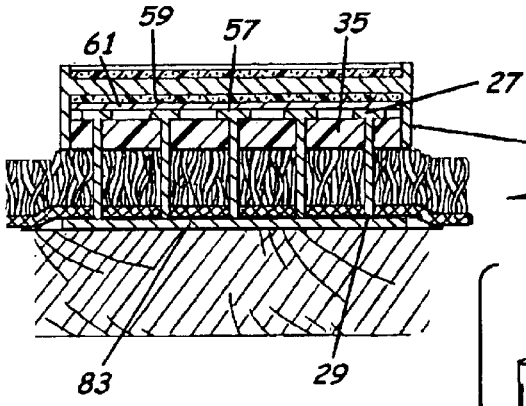
FIG. 10 is a sectional view of a furniture support and carpet protection apparatus according to still yet another embodiment of the present invention.

In an embodiment of the present invention, as best shown in FIGS. 8–9, advantageously, at least two of the shafts 25 of the plurality of posts 23 positioned in the plurality of pre-selected bores 43' of the coaster 35' have different longitudinal lengths to further compensate for irregularities in the flooring 55. The irregularities may include deviations as small as blemishes, as shown in FIGS. 5–7, to ones as large as or larger than and including a carpet tack strip 81 as shown in FIG. 9. In this configuration, a post 23 or subset of posts 23 can have a shorter length than at least one of the other of the plurality of posts 23 within the bores 43' of coaster 35'. These posts 23 having a shorter length are positioned over the portions of a floor 55 more raised than other portions, such as carpet tack strip 81. This positioning of the posts 23 further helps compensate for the irregularities due to the shorter distance between the average height of the proximal heads 27 of the plurality of posts 23 and the upper surface of the carpet tack strip 81 of flooring 55.

A plurality of embodiments of the present invention were described in a form where the carpet 22 overlies the flooring 55 and the carpet includes a carpet pile, a backing connected to and underlying the carpet pile, and typically a carpet pad positioned to underlie, the backing and to overlie an upper surface of flooring 55. In an embodiment of the present invention, each of the distal tips 29 of the plurality of posts 23 are shaped to extend through the carpet 22 and to contact the upper surface of flooring 55. If the flooring 55 is soft, the distal tips 29 of the plurality of posts 23 may tend to blemish the flooring surface. An alternative embodiment of the present invention, shown for illustrative purposes in FIG. 10 as a variation of an implementation of the embodiment of the present invention shown in FIG. 2, advantageously provides protection for such softer flooring structures. The embodiment is specifically designed to use on a soft floor structure and more typically for use with area-type rugs, but may be useful to other rug designs. In this embodiment, the carpet protection apparatus can further include a floor plate 83 positioned to underlie the carpet 22 and to overlie the flooring 55 to support the distal tips 29 of the plurality of posts 23 when under the weight of the furniture structural member 33. This floorplate 83 advantageously further reduces damage to the flooring 55 by providing a surface that is impenetrable to the distal tips 29 of the plurality of posts 23. This alternative embodiment is typically required where the flooring 55 is manufactured of a material such as wood that may tend to be damaged by the distal tips 29. The floor plate 83 can be placed to underlie the area selected by the user to position the furniture structural members 33 of a piece of furniture. For example, the floor plate 83 can be pre-positioned under the anticipated location the carpet protection apparatus 21 prior to placing the carpet 22 to overlie the flooring 55. Also, for example, if the carpet 22 is small enough, the floor plate 83 can be slid under the carpet protection apparatus 21 during placement of the device.

Figure 11:
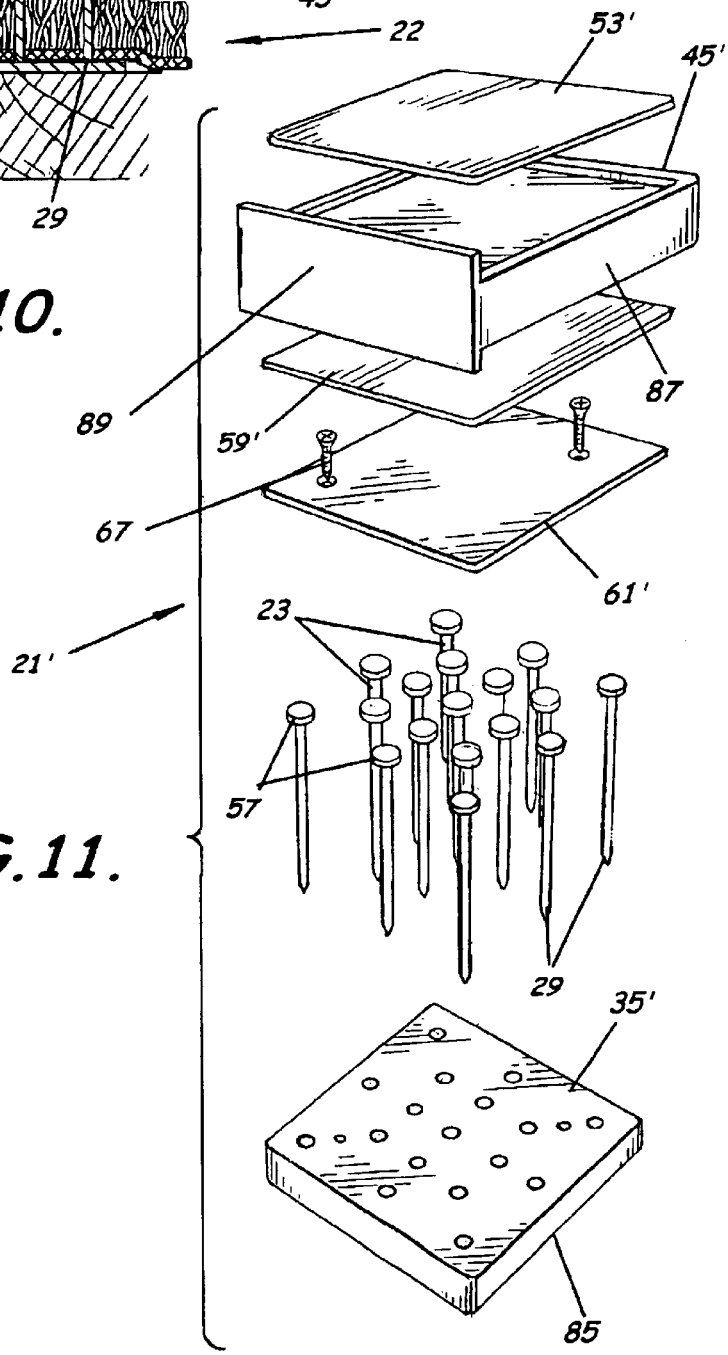
FIG. 11 is an exploded perspective view of a furniture support and carpet protection apparatus of FIG. 2 according to an embodiment of the present invention.

The invention is not limited to any one geometric shape. The invention features various configurations provided to most closely match the general shape of the furniture structural member 33, the furniture support and carpet protector apparatus is implemented to support. For example, as best shown in FIGS. 1, 3–4, 8–9 and 11–12, are a plurality of embodiments where the configuration of the coasters 35' is non-annular, having a plurality of sides 85 forming a lateral periphery substantially perpendicular to the longitudinal axis of the furniture structural member 33. In these embodiments, the coaster cover 45' of the carpet protector apparatus 21' further includes a corresponding plurality of sides 87. For example, FIG. 11 depicts an embodiment of the present invention having a geometric shape in the form of a quadrilateral. Various configurations of this embodiment of apparatus 21' can include a plurality of posts 23, a coaster 35', coaster cover upper mattress 53', coaster cover lower mattress 59', and coaster cover plate 61' with attachment device 67'. The coaster 35' has four sides 85 and the coaster cover 45' correspondingly also has four sides. In this embodiment, at least one of the plurality of sides 87 of the coaster cover 45' can include a flange 89 which protrudes from at least one of the sides 87 and is positioned to restrict lateral displacement of the furniture structural member with respect to the coaster cover 45'. In a configuration where the flange 89 also protrudes below the lower surface of the coaster cover 45' (FIG. 9), the flange 89 also may restrict lateral displacement of the coaster cover 45' with respect to the coaster 35'. The coaster 35' of the carpet protector apparatus 21' having the plurality of sides 85 of various geometric shapes may alternatively include the flange (not shown) similar to flange 89 protruding from at least one of the sides 85. In this configuration (not shown), if the flange is configured to extend above the lower surface of the coaster cover 45', the flange helps restrict lateral displacement of the coaster cover 45' with respect to the coaster 35', and if the flange is further configured to extend above the upper surface of the coaster cover 45', the flange can help restrict lateral displacement of the furniture structural member 33.

Figure 12:
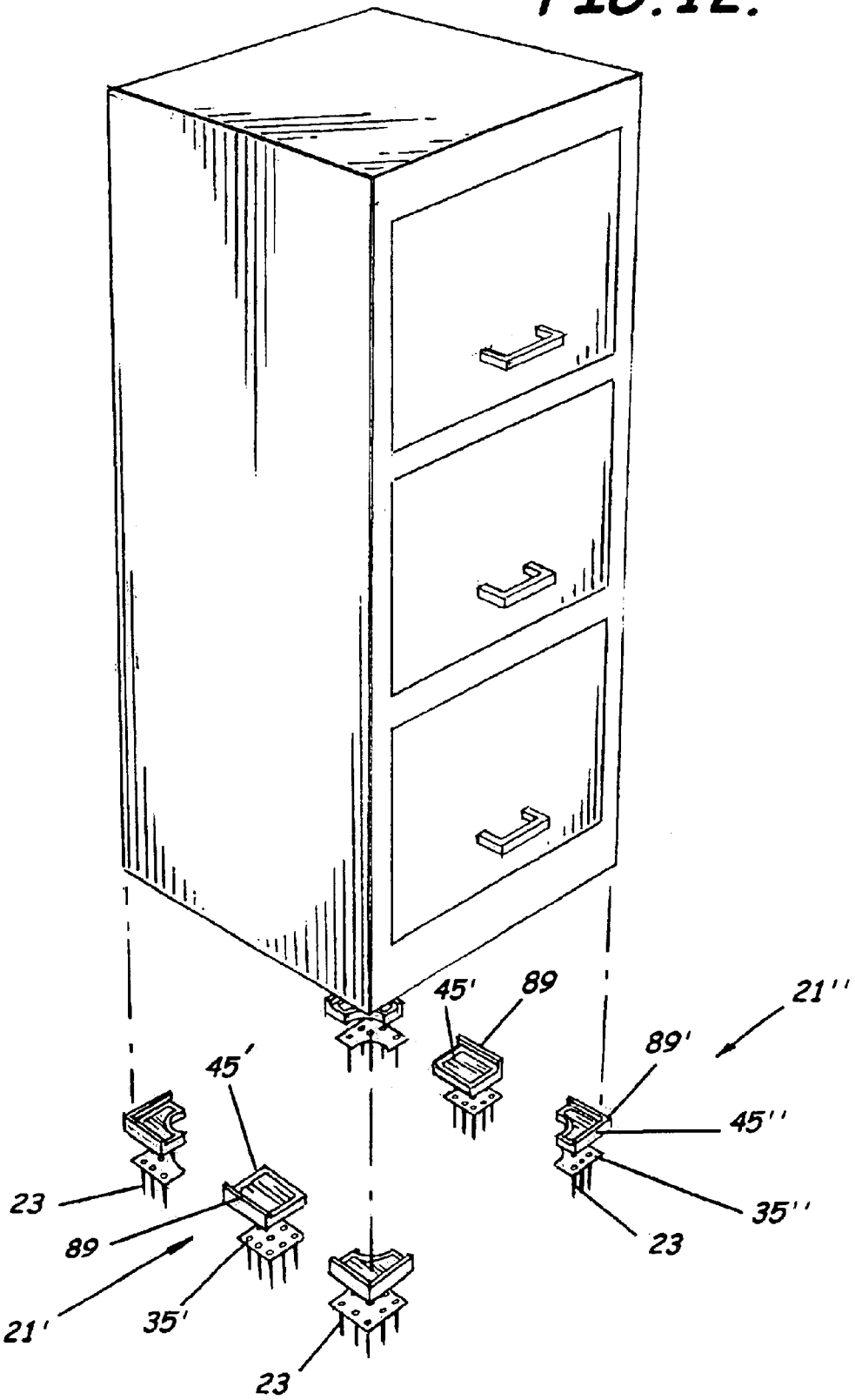
FIG. 12 is a partially exploded perspective view of a furniture support and carpet protection combination of FIG. 1 according to an embodiment of the present invention.

A furniture support and carpet protection apparatus of different geometric designs (e.g. 21, 21', 21") may be implemented to support the various configurations of furniture structural support or members 33. For example, as shown in FIG. 12, six carpet protection apparatus may be implemented in order to best support a file cabinet having a substantially flat lower surface and, as shown in FIG. 1, four carpet protection apparatus may be implemented in order to support a table. Different variations of the type and number of apparatus used (e.g. 21, 21', 21"), however, are typical and still within the scope of the present invention.

By way of illustration only, FIG. 12 shows four corner configurations (FIG. 4) of apparatus 21" and two sides configuration (FIG. 3) of apparatus 21' to provide optimum support. In this configuration, apparatus 21" surrounds the four corners of the file cabinet. Apparatus 21", as shown, includes a plurality of posts 23 supported by coaster 35" and covered by coaster cover 45" having flange 89'. Apparatus 21' further supports the sides of the file cabinet. Apparatus 21' includes a plurality of posts 23 supported by coaster 35' and covered by coaster cover 45' having flange 89. Different variations, even with regard to this illustration, are of course possible and well within the scope of the invention.

Figure 13:
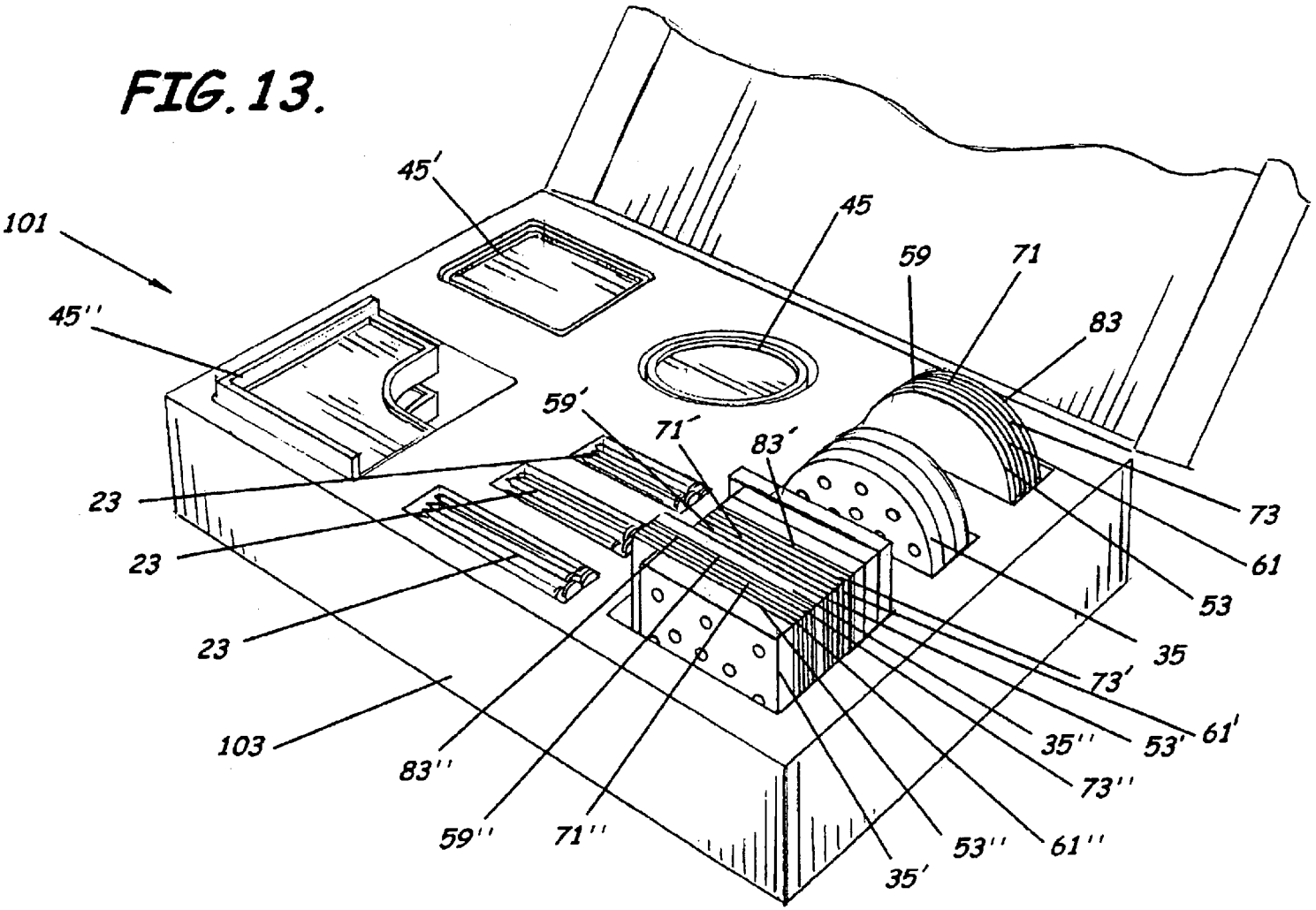
FIG. 13 is a perspective view of a furniture support and carpet protection kit according to an embodiment of the present invention.

Advantageously, an embodiment of the present invention further provides a kit 101 for supporting furniture and reducing damage to an underlying carpet 22. As best shown in FIG. 13, the kit 101 includes a container 103, and a plurality of posts 23 positioned in the container 103 Also referencing the exploded sectional view of a partially assembled carpet protection apparatus 21 (FIG. 6), for example, each of the plurality of posts 23 includes a shaft 25 of a pre-selected length and has a first end and a second end. The first end of the shaft 25 defines a proximal head 27 of the post and the second end of the shaft 25 defines a distal tip 29 of the post 23 shaped to penetrate the carpet 22 when under the weight of a furniture structural member 33 (FIG. 1). In an embodiment of the present invention, the shaft 25 of the each of the plurality of posts 23 has substantially the same diameter throughout the longitudinal extent between the proximal head 27 and the distal tip 29, however, differing diameters are allowable.

The kit 101 also includes a coaster 35 positioned in the container 103 and adapted to be positioned under the furniture structural member 33. The coaster 35 has a coaster body, an upper surface 39, a lower surface 41, and a plurality of bores 43 extending through the coaster body from the upper surface 39 to the lower surface 41. Each of the plurality of bores 43 is adapted to have one of the plurality of posts 23 positioned therein and to extend therethrough the bore 43 to provide radial support to the shaft 25 of each post 23.

The kit 101 also includes a coaster cover 45 positioned in the container 103. The coaster cover 45 has a coaster cover body, an upper surface 49 adapted to be positioned to underlie the furniture structural member 33, and a lower surface 51 adapted to be positioned to overlie the coaster 35. The coaster cover 45 can provide mount support to the furniture structural member 33 when positioned to overlie the carpet 22 so that the coaster cover 45 distributes the weight of the furniture structural member 33 to the proximal head 27 of each of the plurality of posts 23 when the apparatus 21 is assembled.

In an embodiment of the present invention, the kit 101 can further include a coaster cover upper mattress 53 positioned in the container 103 and adapted to be positioned between the upper surface of the coaster cover 45 and the furniture structural member 33 to provide a cushioned surface for the furniture structural member 33 and to restrict lateral movement of the furniture structural member 33 with respect to the coaster cover 45. In the preferred configuration, the coaster cover upper mattress 53 is pre-attached within the kit 101 to the coaster cover 45 using an adhesive or other attachment means as known by those skilled in the art.

In an embodiment of the present invention, the plurality of posts 23 are further adapted to be slidably positioned within the plurality of bores 43 to allow individual longitudinal displacement of thc plurality of shafts 25 of the plurality of posts 23 in order to compensate for irregularities in flooring 55 underlying the carpet 22. In this embodiment, each proximal head 27 of a plurality of posts 23 preferably can have a radial extension extending radially and outwardly from upper end portions of the shaft 25 to define a post head radial extension 57. At least one of the post head radial extensions 57 to slidably engage the upper surface 39 of the coaster 35 to stop the proximal head 27 of the post 23 from extending into the bore 43 of the coaster 35, when positioned therein.

In another embodiment of the present invention, the kit 101 further may include a coaster cover lower mattress 59 (FIG. 7) positioned in the container 103 and adapted to be positioned between the upper surface 39 of the coaster 35 and the lower surface 51 of the coaster cover 45 (FIG. 7). Also referencing FIG. 7, the coaster lower mattress 59, if included and used, is preferably to be positioned to directly or indirectly abuttingly contact each proximal head 27 of the plurality of posts 23 inserted into bores 43 and is compressible by the weight of the furniture structural member 33 when positioned on the coaster cover 45. This feature is to further compensate for differing longitudinal positions of the proximal heads 27 of the plurality of posts 23 when sliding through the plurality of bores 43 of the coaster 35. Additionally, when so positioned, the coaster cover lower mattress 59 can further restrict lateral displacement of the coaster cover with respect to the coaster 35 and provides a cushioned interface for the lower surface 51 of the coaster cover 45, In another embodiment of the present invention, the kit 101 can include a coaster cover plate 61. The coaster cover plate 61 is positioned in the container 103 and has an upper surface 63 adapted to underlie the coaster cover 45 and has a lower surface 65 overlying the coaster 35 to provide structural protection to the coaster cover 45 from the plurality of posts. A plurality of the proximal heads 27 of the plurality of posts 23 are adapted to be positioned to abut the lower surface 65 of the coaster cover plate 61 to stop the plurality of posts 23 from extending out of the plurality of bores 43 of the coaster 35. The coaster cover plate structure can stop the plurality of posts 23 from extending out of plurality of the bores 43 of the coaster, when positioned therein. The coaster cover plate 61 is preferably also adapted to be slidably connected to and positioned adjacent the upper surface 39 of the coaster 35. When so positioned, the coaster cover plate 61 directly or indirectly abuttingly contacts at least two proximal heads 27 of the plurality of posts 23 to help further compensate for differing longitudinal positions of the proximal heads 27 of the plurality of posts 23 when sliding through the plurality of bores 43 of the coaster 35.

In an embodiment of the present invention, the coaster cover plate 61 includes a first mattress 71 adapted to be positioned between the upper surface 39 of the coaster 35 and the lower surface 65 of the coaster cover plate 61. When so positioned, the first mattress 71 abuttingly contacts each proximal head 27 of the plurality of posts 23 and is compressible by the weight of the furniture structural member 33. When positioned in conjunction with the first mattress 71, the coaster cover plate 61 allows for differing longitudinal positions of the proximal heads 27 of the plurality of posts 23 with respect to the upper surface 39 of the coaster 35 when the posts 23 are positioned to slide through the plurality of bores 43 of the coaster 35. The first mattress 71 may be attached to coaster cover plate 61 or provided as a separate unit. When provided as a separate unit, the first mattress 71 performs a similar function to that of the coaster cover lower mattress 59 with respect to the plurality of posts 23 and may be interchangeable with the coaster cover lower mattress 59.

In an embodiment of the present invention, the coaster cover plate 61 can further include a second mattress 73 attached to the upper surface 63 of the coaster cover plate 61 to provide a cushioned surface for the furniture structural member 33 and to help restrict lateral movement of the furniture structural member 33 with respect to the coaster cover 45. If the coaster cover 45 is to be utilized, the second mattress 73 can be provided to also help restrict lateral movement of the coaster cover 45 with respect to the coaster 35 and/or provide a cushioned surface for the coaster cover 45, depending upon the material selected for its construction.

In an alternative embodiment of the present invention, at least one of the coaster cover 45 and the coaster cover plate 61 can include magnetic material and at least one of the coaster cover 45 and the coaster cover plate 61 includes magnetically responsive material to restrict movement of the coaster cover 45 with respect to the coaster 35. The combination of magnetic material and magnetically responsive material creates a magnetic attachment.

In an embodiment of the present invention, the coaster cover 45 can further have an annular flange 75 positioned to substantially surround the coaster cover 45 to provide stable positioning of the furniture support and carpet protection apparatus 21 between the furniture structural member 33 and the floor 55, when positioned therebetween. Also in the preferred embodiment of the present invention, the annular flange 75 protrudes outwardly from both the upper and lower periphery of the body of the coaster cover 45 to help restrict lateral displacement of the coaster cover 45 with respect to the coaster 35 and to help restrict lateral displacement of the furniture structural support or member 35 with respect to the coaster cover 45, when positioned therebetween. Either the coaster body of the coaster 35 or the coaster cover body of the coaster cover 45, however, may have an annular flange 75 protruding outwardly from peripheries thereof and still should provide adequate structural support between the coaster 35 and the coaster cover 45. Advantageously, at least two of the plurality of posts 23 can have shafts 25 of different longitudinal lengths that are adapted to be positioned in the plurality of pre-selected bores 43 of the coaster 35 to compensate for irregularities in the flooring 55. As described above, the differing lengths can be utilized to compensate for irregularities in floor 55 by placing one or more shafts 25 having a shorter length in portions of the floor 55 more raised than other portions.

In an embodiment, each of the distal tips 29 of the plurality of posts 23 are shaped to extend through and to contact the upper surface of flooring 55, when positioned under the furniture structural member 33. In an alternative embodiment of the present invention, primarily designed for delicate flooring and typically used with area-type rugs, the kit 101 further includes a floor plate 83 adapted to be positioned to underlie the carpet 22 and to overlie the flooring 55 to support the distal tips 29 of the plurality of posts 23 when positioned under the weight of the furniture structural member 33 to reduce damage to the flooring 55.

The kit 101 was generally described referencing a carpet protection apparatus 21 having an annular shape (FIG. 6). The flooring support and carpet protector apparatus may have various geometric shapes alone or in combination and generally pre-selected to be included with kits 101 featuring different embodiments of the present invention. For example, in an alternative embodiment, the kit 101 may include an apparatus 21', such as that shown in FIG. 11. The apparatus 21' can include a plurality of posts 23, a coaster 35', coaster cover 45', coaster cover upper mattress 53', coaster coyer lower mattress 59', and caster cover plate 61' optionally having coaster cover mattress 71', 73'. The apparatus 21' has a coaster cover 45' that includes a plurality of sides 87 forming a lateral periphery substantially perpendicular to the furniture structural member 33. In this embodiment, at least one of the plurality of sides 87 can include a flange 89 protruding from at least one of the sides 87 and can be positioned to restrict lateral displacement of the furniture structural support or member 33 with respect to the coaster cover 45', when the coaster cover 45' is positioned thereunder. In an implementation where the flange 89 protrudes both above the upper surface of the coaster cover 45' and below the lower surface of the coaster cover 45', the flange 89 may be positioned to restrict both lateral displacement of the furniture structural support or member 33 with respect to the coaster cover 45' and restrict lateral displacement of the coaster cover 45' with respect to the coaster 35' when the coaster cover 45' is positioned therebetween. The kit 101 corresponding may also include the furniture support and carpet protector apparatus 21" (FIG. 12). The apparatus 21" can include a plurality of posts 23, a coaster 35", coaster cover 45", coaster cover upper mattress 53", coaster cover lower mattress 59", and coaster cover plate 61" optionally having coaster cover mattresses 71', 73'. The kit 101 can further include floor plates 83', 83".

Advantageously, an embodiment of the present invention also provides a method of using a furniture support and carpet protection apparatus 21 for supporting furniture and reducing damage to a carpet. With reference to FIGS. 6 and 9, for illustrative purposes only, the method includes positioning a coaster 35 on a selected piece of carpet 22, the coaster 35 having a coaster body, an upper surface 39, a lower surface 41, and a plurality of bores 43 extending through the coaster body from the upper surface 39 to the lower surface 41. The method also includes positioning a pre-selected number of the plurality of posts 23 through the plurality of bores 43 in the coaster 35. The length of each of the posts 23 is preferably selected dependent upon the combined height of a carpet 22 and any irregularities. The irregularities include deviations as small as blemishes to ones as large as or larger than and including a carpet tack strip 81 (FIG. 9). The method also includes connecting a coaster cover plate 61 to the coaster 35 adjacent the upper surface 39 of the coaster 35, and placing the coaster cover plate 61 in direct or indirect abutting contact with at least two proximal heads 27 of the plurality of posts 23. This is accomplished to further compensate for differing longitudinal positions of the proximal heads 27 of the plurality of posts 23 when sliding through the plurality of bores 43 of the coaster 35.

In another embodiment of a method of using a furniture support and carpet protection apparatus for supporting furniture and reducing damage to a carpet, the method includes positioning a coaster 35 on a selected piece of carpet 22. The coaster has a coaster body, an upper surface 39, a lower surface 41, and a plurality of bores 43 extending through the coaster body from the upper surface 39 to the lower surface 41. The method also includes positioning a pre-selected number of the plurality of posts 23 through the plurality of bores 43 in the coaster. The length of each of the posts 23 is preferably selected dependent upon the combined height of a carpet 22 and any irregularities. The irregularities include deviations as small as blemishes to ones as large as or larger than and including a carpet tack strip 81 (FIG. 9). The method also includes positioning a coaster cover 45 adjacent the upper surface 39 of the coaster 35, and placing at least one of the coaster cover 45 and coaster cover lower mattress 59 (FIG. 7) in abuttingly contact with at least two proximal heads 27 of the plurality of posts 23. This is accomplished to help further compensate for differing longitudinal positions of the proximal heads 27 of the plurality of posts 23 when sliding through the plurality of bores 43 of the coaster 35.

In another embodiment of a method of using a furniture support and carpet protection apparatus for supporting furniture and reducing damage to a carpet, the method includes positioning a coaster 35 on a selected piece of carpet 22. The coaster 35 is as described above in the previous two embodiments. The method also includes positioning a plurality of posts 23 through the plurality of bores 43 in the coaster 35. Each of the plurality of posts 23 has a shaft 25 of a preferably pre-selected length, a proximal head 27, and a distal tip 29. The number of posts 23 that are positioned through the bores are dependent upon a weight bearing load carried by a furniture structural member 33. The length of each of the posts 23 positioned through the bores 43 is selected dependent upon the combined height of a carpet 22 and/or flooring 55. The method also includes covering the coaster 35 and the plurality of posts 23 with a coaster cover 45 having an upper surface and a lower surface. The coaster cover 45 provides mount support to the furniture structural member 33 when positioned to overlie the carpet 22. The method also includes positioning the furniture structural member 33 atop the upper surface of the coaster cover 45.

In an embodiment of the present invention, the method also includes the step of connecting a coaster cover plate 61 to the coaster 35 adjacent the upper surface of the coaster 35, and placing the coaster cover plate 61 in contact with at least two proximal heads 27 of the plurality of posts 23. Preferably the coaster cover plate 61 is not tightly secured to the coaster 35 but is instead allowed a pre-selected amount of longitudinal movement or play. This is to further compensate for differing longitudinal positions of the proximal heads 27 of the plurality of posts 23 when sliding through the plurality of bores 43 of the coaster 35.

In an embodiment of the present invention, the method further includes selectively adjusting the length of a subset of posts 23 of the plurality of posts 23 positioned between the coaster 35 and a coaster cover 45, to compensate for an irregularity greater than at minimum, the thickness of a coaster cover lower mattress 59 (FIG. 7) or cover plate first mattress 71, (FIG. 6), depending on the configuration if used as described above.

The methods described above generally referenced the furniture support and carpet protector 21 for illustrative purposes. The methods are equally applicable to alternative configurations of the apparatus such as those described with reference to the apparatus 21' and 21".

In the drawings and specification, there have been disclosed a typical preferred embodiment of the present invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, screws may be substituted for the posts. Also, for example, the invention will function where the furniture structural member is in the form of a caster. Also, for example, the various components of the apparatus, especially the coaster cover, may feature decorative designs to match either the furniture for the carpet.

What is claimed is:

1. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, the plurality of posts slidably positioned therein and extending therethrough to allow individual longitudinal displacement of the plurality of shafts of the plurality of posts to compensate for irregularities in flooring underlying the carpet;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weigh of the furniture structural member to the proximal head of the posts; and a coaster cover upper mattress positioned between the upper surface of the coaster cover and the furniture structural member to provide a cushioned surface for the furniture structural member and to restrict lateral movement of the furniture structural member with respect to the coaster cover.

2. An apparatus as defined in claim 1, wherein each proximal head of the plurality of posts has a radial extension extending radially and outwardly from upper end portions of the shaft to define a post head radial extension, at least one of the post head radial extensions slidably engaging the upper surface of the coaster to stop the proximal head of the post from extending into the bore of the coaster.

3. An apparatus as defined in claim 1, further comprising a coaster cover lower mattress positioned between the upper surface of the coaster and the lower surface of the coaster cover, abuttingly contacting each proximal head of the plurality of posts and being compressible by the weight of the furniture structural member when positioned on the coaster cover to further compensate for differing longitudinal positions of the proximal heads of the plurality of posts when sliding through the plurality of bores of the coaster, wherein the coaster cover lower mattress further restricts lateral displacement of the coaster cover with respect to the coaster and provides a cushioned interface for the lower surface of the coaster cover.

4. An apparatus as defined in claim 1, further comprising a coaster cover plate having an upper surface underlying the coaster cover and a lower surface overlying the coaster and providing structural protection to the coaster cover from the plurality of posts, and wherein a plurality of the proximal heads of the plurality of posts abut the lower surface of the coaster cover plate to stop the plurality of posts from extending out of plurality of the bores of the coaster.

5. An apparatus as defined in claim 4, wherein the coaster cover plate is slidably connected to and positioned adjacent the upper surface of the coaster, abuttingly contacting at least two proximal heads of the plurality of posts to further compensate for differing longitudinal positions of the proximal heads of the plurality of posts when sliding through the plurality of bores of the coaster.

6. An apparatus as defined in claim 5, wherein the coaster cover plate includes a first mattress positioned between the upper surface of the coaster and the lower surface of the coaster cover plate and abuttingly contacting each proximal head of the plurality of posts and compressible by the weight of the furniture structural member, the coaster cover plate to allow for differing longitudinal positions of the proximal heads of the plurality of posts with respect to the upper surface of the coaster when sliding through the plurality of bores of the coaster.

7. An apparatus as defined in claim 6, wherein the coaster cover plate further includes a second mattress affixed to the upper surface of the coaster cover plate to provide a cushioned surface for the furniture structural member and to restrict lateral movement of the furniture structural member with respect to the coaster cover.

8. An apparatus as defined in claim 4, wherein the coaster cover plate includes a cover plate mattress attached to the upper surface of the coaster cover plate to provide a cushioned surface for the furniture structural member and to restrict lateral movement of the furniture structural member with respect to the coaster cover.

9. An apparatus as defined in claim 1, wherein the carpet includes a carpet pile, wherein the coaster abuts the upper surface of the carpet pile, and wherein the coaster cover further has an annular flange positioned to substantially surround the coaster cover to provide stable positioning of the furniture support and carpet protection apparatus between the furniture structural member and the floor.

10. An apparatus as defined in claim 1, wherein at least two of the shafts of the plurality of posts positioned in the plurality of pre-selected bores of the coaster have different longitudinal lengths to further compensate for irregularities in the flooring.

11. An apparatus as defined in claim 1, wherein the shaft of the each of the plurality of posts has substantially the same diameter throughout the longitudinal extent between the proximal head and the distal tip.

12. An apparatus as defined in claim 1, wherein the carpet overlies the flooring and comprises a carpet pile, a backing connected to and underlying the carpet pile, and a carpet pad positioned to underlie the backing and to overlie an upper surface of flooring, and wherein each of the distal tips of the plurality of posts are shaped to extend through and to contact the upper surface of flooring.

13. An apparatus as defined in claim 1, wherein the coaster cover further includes a plurality of sides forming a lateral periphery substantially perpendicular to the furniture structural member, wherein at least one of the plurality of sides includes a first flange protruding from the at least one of the sides and positioned to restrict lateral displacement of the furniture structural support with respect to the coaster cover.

14. An apparatus as defined in claim 13, wherein at least one of the plurality of sides of the coaster cover includes a second flange protruding from the at least one of the sides and positioned to restrict lateral displacement of the coaster cover with respect to the coaster.

15. A furniture support and carnet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, at least three of the bores having one of the posts positioned therein and extending therethrough;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of the posts;

a coaster cover upper mattress positioned between the upper surface of the coaster cover and the furniture structural member to provide a cushioned surface for the furniture structural member and to restrict lateral movement of the furniture structural member with respect to the coaster cover; and a coaster cover plate having an upper surface underlying the coaster cover and a lower surface overlying the coaster, and wherein at least one of the coaster cover and the coaster cover plate includes magnetic material and at least one of the coaster cover and the coaster cover plate includes magnetically responsive material to restrict movement of the coaster cover with respect to the coaster.

16. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, at least three of the bores having one of the posts positioned therein and extending therethrough;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of the posts;

a coaster cover upper mattress positioned between the upper surface of the coaster cover and the furniture structural member to provide a cushioned surface for the furniture structural member and to restrict lateral movement of the furniture structural member with respect to the coaster cover; and wherein at least one of the coaster body of the coaster and the coaster cover body of the coaster cover has an annular flange protruding outwardly from peripheries thereof to restrict lateral displacement of the coaster cover with respect to the coaster and restrict lateral displacement of the furniture structural support with respect to the coaster.

17. An apparatus as defined in claim 16, wherein the coaster cover body of the coaster cover has an annular flange protruding outwardly from both the upper and lower periphery of the coaster cover body to restrict lateral displacement of the coaster cover with respect to the coaster and to restrict lateral displacement of the furniture structural support with respect to the coaster cover.

18. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tie of the post shaped to penetrate the carpet when under the weight of a furniture structural member;

a coaster having a coaster body, an upper surface, a lower surface and a plurality of bores extending through the coaster body from the upper surface to the lower surface, at least three of the bores having one of the posts positioned therein and extending therethrough;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head posts;

a coaster cover upper mattress positioned between the upper surface of the coaster cover and the furniture structural member to provide a cushioned surface for the furniture structural member and to restrict lateral movement of the furniture structural member with respect to the coaster cover; and a floor plate positioned to underlie the carpet and to overlie flooring to support the distal tips of the plurality of posts when under the weight of the furniture structural member to reduce damage to the flooring.

19. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, the plurality of posts slidably positioned therein and extending therethrough to allow individual longitudinal displacement of the plurality of shafts of the plurality of posts to compensate for irregularities in flooring underlying the carpet; and a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts.

20. An apparatus as defined in claim 19, wherein each proximal head of the plurality of posts has a radial extension extending radially and outwardly from upper end portions of the shaft to define a post head radial extension, at least one of the post head radial extensions slidably engaging the upper surface of the coaster to stop the proximal head of the post from extending into the bore of the coaster.

21. An apparatus as defined in claim 19, further comprising a coaster cover lower mattress positioned between the upper surface of the coaster and the lower surface of the coaster cover, abuttingly contacting each proximal head of the plurality of posts and being compressible by the weight of the furniture structural member when positioned on the coaster cover to further compensate for differing longitudinal positions of the proximal heads of the plurality of posts when sliding through the plurality of bores of the coaster, wherein the coaster cover lower mattress further restricts lateral displacement of the coaster cover with respect to the coaster and provides a cushioned interface for the lower surface of the coaster cover.

22. An apparatus as defined in claim 19, further comprising a coaster cover plate having an upper surface underlying the coaster cover and a lower surface overlying the coaster and providing structural protection to the coaster cover from the plurality of posts, and wherein a plurality of the proximal heads of the plurality of posts abut the lower surface of the coaster cover plate to stop the plurality of posts from extending out of plurality of the bores of the coaster.

23. An apparatus as defined in claim 22, wherein the coaster cover plate is slidably connected to and positioned adjacent the upper surface of the coaster, abuttingly contacting at least two proximal heads of the plurality of posts to further compensate for differing longitudinal positions of the proximal heads of the plurality of posts when sliding through the plurality of bores of the coaster.

24. An apparatus as defined in claim 23, wherein the coaster cover plate includes a first mattress positioned between the upper surface of the coaster and the lower surface of the coaster cover plate and abuttingly contacting each proximal head of the plurality of posts and compressible by the weight of the furniture structural member, the coaster cover plate to allow for differing longitudinal positions of the proximal heads of the plurality of posts with respect to the upper surface of the coaster when sliding through the plurality of bores of the coaster.

25. An apparatus as defined in claim 24, wherein the coaster cover plate further includes a second mattress affixed to the upper surface of the coaster cover plate to provide a cushioned surface for the furniture structural member and to restrict lateral movement of the furniture structural member with respect to the coaster cover.

26. An apparatus as defined in claim 22, wherein the coaster cover plate includes a cover plate mattress attached to the upper surface of the coaster cover plate to provide a cushioned surface for the furniture structural member and to restrict lateral movement of the furniture structural member with respect to the coaster cover.

27. An apparatus as defined in claim 19, wherein the carpet includes a carpet pile, wherein the coaster abuts the upper surface of the carpet pile, and wherein the coaster cover further has an annular flange positioned to substantially surround the coaster cover to provide stable positioning of the furniture support and carpet protection apparatus between the furniture structural member and the floor.

28. An apparatus as defined in claim 19, wherein at least two of the shafts of the plurality of posts positioned in the plurality of pre-selected bores of the coaster have different longitudinal lengths to further compensate for irregularities in the flooring.

29. An apparatus as defined in claim 19, wherein the shaft of the each of the plurality of posts has substantially the same diameter throughout the longitudinal extent between the proximal head and the distal tip.

30. An apparatus as defined in claim 19, wherein the carpet overlies the flooring and comprises a carpet pile, a backing connected to and underlying the carpet pile, and a carpet pad positioned to underlie the backing and to overlie an upper surface of flooring, and wherein each of the distal tips of the plurality of posts are shaped to extend through and to contact the upper surface of flooring.

31. An apparatus as defined in claim 19, wherein the coaster cover further includes a plurality of sides forming a lateral periphery substantially perpendicular to the furniture structural member, wherein at least one of the plurality of sides includes a first flange protruding from the at least one of the sides and positioned to restrict lateral displacement of the furniture structural support with respect to the coaster cover.

32. An apparatus as defined in claim 31, wherein at least one of the plurality of sides of the coaster cover includes a second flange protruding from the at least one of the sides and positioned to restrict lateral displacement of the coaster cover with respect to the coaster.

33. A furniture support and carpet protection apparatus for supporting furniture and reducing damage to an underlying carpet, the apparatus comprising:

a plurality of posts each including a shaft of a pre-selected length and having a and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, at least three of the bores having one of the posts positioned therein and extending therethrough;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts; and a coaster cover plate having an upper surface underlying the coaster cover and a lower surface overlying the coaster, and wherein at least one of the coaster cover and the coaster cover plate includes magnetic material and at least one of the coaster cover and the coaster cover plate includes magnetically responsive material to restrict movement of the coaster cover with respect to the coaster.

34. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, at least three of the bores having one of the posts positioned therein and extending therethrough;

a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts; and wherein at least one of the coaster body of the coaster and the coaster cover body of the coaster cover has an annular flange protruding outwardly from peripheries thereof to restrict lateral displacement of the coaster cover with respect to the coaster and restrict lateral displacement of the furniture structural support with respect to the coaster.

35. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, at least three of the bores having one of the posts positioned therein and extending therethrough;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts; and wherein the coaster cover body of the coaster cover has an annular flange protruding outwardly from both the upper and lower periphery of the coaster cover body to restrict lateral displacement of the coaster cover with respect to the coaster and to restrict lateral displacement of the furniture structural support with respect to the coaster cover.

36. A furniture support and carpet protection apparatus for supporting furniture and reducing damage to an underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster having a coaster body, an upper surface, a lower surface, and a plurality of bores extending through the coaster body from the upper surface to the lower surface, at least three of the bores having one of the posts positioned therein and extending therethrough;

a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts; and a floor plate positioned to underlie the carpet and to overlie flooring to support the distal tips of the plurality of posts when under the weight of the furniture structural member to reduce damage to the flooring.

37. A furniture support and carpet protection combination, the combination comprising:

a piece of furniture having a furniture structural member, supported by a flooring having irregularities;

a carpet positioned between the furniture structural member and the flooring; and a furniture support and carpet protection apparatus for supporting furniture and reducing damage to the underlying carpet, the apparatus comprising:

a plurality of posts each including a shaft of a pre-selected length and having a first end and a second end the first end of the shaft defining a proximal head of the post and the second end of the shaft defining a distal tip of the post shaped to penetrate the carpet when under the weight of a furniture structural member, a coaster having a coaster body, an upper surface, a lower surface, and a plurality of bores extending through the coaster body from the upper surface to the lower surface, the plurality of posts slidably positioned therein and extending therethrough to allow individual longitudinal displacement of the plurality of shafts of the plurality of posts to compensate for irregularities in flooring underlying the carpet, and a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts.

38. A combination as defined in claim 37, further comprising a coaster cover upper mattress positioned between the upper surface of the coaster cover and the furniture structural member to provide a cushioned surface for the furniture structural member and to restrict lateral movement of the furniture structural member with respect to the coaster cover.

39. A combination as defined in claim 37, wherein each proximal head of the plurality of posts has a radial extension extending radially and outwardly from upper end portions of the shaft to define a post head radial extension, at least one of the post head radial extensions slidably engaging the upper surface of the coaster to stop the proximal head of the post from extending into the bore of the coaster.

40. A combination as defined in claim 37, further comprising a coaster cover lower mattress positioned between the upper surface of the coaster and the lower surface of the coaster cover, abuttingly contacting each proximal head of the plurality of posts and being compressible by the weight of the furniture structural member when positioned on the coaster cover to further compensate for differing longitudinal positions of the proximal heads of the plurality of posts when sliding through the plurality of bores of the coaster, wherein the coaster cover lower mattress further restricts lateral displacement of the coaster cover with respect to the coaster and provides a cushioned interface for the lower surface of the coaster cover.

41. A combination as defined in claim 37, further comprising a coaster cover plate having an upper surface underlying the coaster cover and a lower surface overlying the coaster and providing structural protection to the coaster cover from the plurality of posts, and wherein a plurality of the proximal heads of the plurality of posts abut the lower surface of the coaster cover plate to stop the plurality of posts from extending out of plurality of the bores of the coaster.

42. A combination as defined in claim 41, wherein the coaster cover plate is slidably connected to and positioned adjacent the upper surface of the coaster, abuttingly contacting at least two proximal heads of the plurality of posts to further compensate for differing longitudinal positions of the proximal heads of the plurality of posts when sliding through the plurality of bores of the coaster.

43. A combination as defined in claim 42, wherein the coaster cover plate includes a first mattress positioned between the upper surface of the coaster and the lower surface of the coaster cover plate and abuttingly contacting each proximal head of the plurality of posts and compressible by the weight of the furniture structural member, the coaster cover plate to allow for differing longitudinal positions of the proximal heads of the plurality of posts with respect to the upper surface of the coaster when sliding through the plurality of bores of the coaster.

44. A combination as defined in claim 43, wherein the coaster cover plate further includes a second mattress affixed to the upper surface of the coaster cover plate to provide a cushioned surface for the furniture structural member and to restrict lateral movement of the furniture structural member with respect to the coaster cover.

45. A combination as defined in claim 42, wherein the coaster cover plate includes a cover plate mattress attached to the upper surface of the coaster cover plate to provide a cushioned surface for the furniture structural member and to restrict lateral movement of the furniture structural member with respect to the coaster cover.

46. A combination as defined in claim 37, wherein at least two of the shafts of the plurality of posts positioned in the plurality of pre-selected bores of the coaster have different longitudinal lengths to further compensate for irregularities in the flooring.

47. A combination as defined in claim 37, wherein the shaft of the each of the plurality of posts has substantially the same diameter throughout the longitudinal extent between the proximal head and the distal tip.

48. A combination as defined in claim 37, wherein the coaster cover further includes a plurality of sides forming a lateral periphery substantially perpendicular to the furniture structural member, wherein at least one of the plurality of sides includes a flange protruding from the at least one of the sides and positioned to restrict lateral displacement of the furniture structural support with respect to the coaster cover.

49. A combination as defined in claim 48, wherein at least one of the plurality of sides of the coaster cover includes a second flange protruding from the at least one of the sides and positioned to restrict lateral displacement of the coaster cover with respect to the coaster.

50. A furniture support and carpet protection combination, the combination comprising:

a piece of furniture having a furniture structural member, supported by flooring having irregularities;

a carpet positioned between the furniture structural member and the flooring; and a furniture support and carpet protection apparatus for supporting furniture and reducing damage to the underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member, a coaster having a coaster body, an upper surface, a lower surface, and a plurality of bores extending through the coaster body from the upper surface to the lower surface, at least three of the bores having one of the posts positioned therein and extending therethrough, a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts, a coaster cover plate having an upper surface underlying the coaster cover and a lower surface overlying the coaster, and wherein at least one of the coaster cover and the coaster cover plate includes magnetic material and at least one of the coaster cover and the coaster cover plate includes magnetically responsive material to restrict movement of the coaster cover with respect to the coaster.

51. A combination as defined in claim 50, wherein the carpet includes a carpet pile, wherein the coaster abuts the upper surface of the carpet pile, and wherein the coaster cover further has an annular flange positioned to substantially surround the coaster cover to provide stable positioning of the furniture support and carpet protection apparatus between the furniture structural member and the floor.

52. A furniture support and carpet protection combination, the combination comprising:

a piece of furniture having a furniture structural member, supported by a flooring having irregularities;

a carpet positioned between the furniture structural member and the flooring; and a furniture support and carpet protection apparatus for supporting furniture and reducing damage to the underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member, a coaster having a coaster body, an upper surface, a lower surface, and a plurality of bores extending through the coaster body from the upper surface to the lower surface, at least three of the bores having one of the posts positioned therein and extending therethrough, a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts, and wherein at least one of the coaster body of the coaster and the coaster cover body of the coaster cover has an annular flange protruding outwardly from peripheries thereof to restrict lateral displacement of the coaster cover with respect to the coaster and restrict lateral displacement of the furniture structural support with respect to the coaster.

53. A combination as defined in claim 52, wherein the coaster cover body of the coaster cover has an annular flange protruding outwardly from both the upper and lower periphery of the coaster cover body to restrict lateral displacement of the coaster cover with respect to the coaster and to restrict lateral displacement of the furniture structural support with respect to the coaster cover.

54. A combination as defined in claim 52, wherein the carpet overlies the flooring and comprises a carpet pile, a backing connected to and underlying the carpet pile, and a carpet pad positioned to underlie the backing and to overlie an upper surface of flooring, and wherein each of the distal tips of the plurality of posts are shaped to extend through and to contact the upper surface of flooring.

55. A furniture support and carpet protection combination, the combination comprising:

a piece of furniture having a furniture structural member, supported by a flooring having irregularities;

a carpet positioned between the furniture structural member and the flooring; and a furniture support and carpet protection apparatus for supporting furniture and reducing damage to the underlying carpet, the apparatus comprising:

a plurality of posts each including a shaft of a pre-selected length and having a first end and a second end, the first end of the shaft defining a proximal head of the post and the second end of the shaft defining a distal tip of the post shaped to penetrate the carpet when under the weight of a furniture structural member, a coaster having a coaster body, an upper surface, a lower surface, and a plurality of bores extending through the coaster body from the upper surface to the lower surface, at least three of the bores having one of the posts positioned therein and extending therethrough, a coaster cover having a coaster cover body, an upper surface positioned to underlie the furniture structural member, and a lower surface overlying the coaster, the coaster cover providing mount support to the furniture structural member when positioned to overlie the carpet so that the coaster cover distributes the weight of the furniture structural member to the proximal head of each of the plurality of posts, and a floor plate positioned to underlie the carpet and to overlie flooring to support the distal tips of the plurality of posts when under the weight of the furniture structural member to reduce damage to the flooring.

56. A furniture, support and carpet protection apparatus kit for supporting furniture and reducing damage to an underlying carpet, the kit comprising:

a container;

a plurality of in the container and each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster positioned in the container and adapted to be positioned under the furniture structural member, the coaster having a coaster body, an upper surface, a lower surface, and a plurality of bores extending through the coaster body from the upper surface to the lower surface, each of the bores adapted to have one of the posts positioned therein and extend therethrough, the plurality of posts adapted to be slidably positioned within the plurality of bores to allow individual longitudinal displacement of the plurality of shafts of the plurality of posts to compensate for irregularities in flooring underlying the carpet; and a coaster cover positioned in the container and having a coaster cover body, an upper surface adapted to be positioned to underlie the furniture structural member, and a lower surface adapted to be positioned to overlie the coaster cover providing mount support to the furniture structural member when positioned to overlie the carpet so that the coaster cover distributes the weight of the furniture structural member to the proximal head of each of the plurality of posts.

57. A kit as defined in claim 56, further comprising a coaster cover upper mattress positioned in the container and adapted to be positioned between the upper surface of the coaster cover and the furniture structural member to provide a cushioned surface for the furniture structural member and to restrict lateral movement of the furniture structural member with respect to the coaster cover.

58. A kit as defined in claim 56, wherein each proximal head of the plurality of posts has a radial extension extending radially and outwardly from upper end portions of the shaft to define a post head radial extension, at least one of the post head radial extensions slidably engaging the upper surface of the coaster to stop the proximal head of the post from extending into the bore of the coaster, when positioned therein.

59. A kit as defined in claim 56, further comprising a coaster cover plate positioned in the container and having an upper surface adapted to underlie the coaster cover and have a lower surface overlying the coaster to provide structural protection to the coaster cover from the plurality of posts, and wherein a plurality of the proximal heads of the plurality of posts are adapted to abut the lower surface of the coaster cover plate to stop the plurality of posts from extending out of the plurality of bores of the coaster.

60. A kit as defined in claim 59, wherein the coaster cover plate is adapted to be slidably connected to and positioned adjacent the upper surface of the coaster, contacting at least two proximal heads of the plurality of posts to further compensate for differing longitudinal positions of the proximal heads of the plurality of posts when sliding through the plurality of bores of the coaster.

61. A kit as defined in claim 60, wherein the coaster cover plate includes a first mattress adapted to be positioned between the upper surface of the coaster and the lower surface of the coaster cover plate and to abuttingly contact each proximal head of the plurality of posts and compressible by the weight of the furniture structural member, the coaster cover plate to allow for differing longitudinal positions of the proximal heads of the plurality of posts with respect to the upper surface of the coaster when sliding through the plurality of bores of thc coaster.

62. A kit as defined in claim 61, wherein the coaster cover plate further includes a second mattress attached to the upper surface of the coaster cover plate to provide a cushioned surface for the furniture structural member and to restrict lateral movement of the furniture structural member with respect to the coaster cover.

63. A kit as defined in claim 59, wherein the coaster cover plate includes a coverplate mattress attached to the upper surface of the coaster cover plate to provide a cushioned surface for the furniture structural member and to restrict lateral movement of the furniture structural member with respect to the coaster cover, when positioned thereon.

64. A kit as defined in claim 56, wherein the carpet includes a carpet pile, wherein the coaster is adapted to abut the upper surface of the carpet pile, and wherein the coaster cover further has an annular flange positioned to substantially surround the coaster cover to provide stable positioning of the furniture support and carpet protection apparatus between the furniture structural member and the floor, when positioned therebetween.

65. A kit as defined in claim 56, wherein at least one of the coaster body of the coaster and the coaster cover body of the coaster cover has an annular flange protruding outwardly from peripheries thereof to restrict lateral displacement of the coaster cover with respect to the coaster and restrict lateral displacement of the furniture structural support with respect to the coaster, when positioned together under the furniture structural support.

66. A kit as defined in claim 56, wherein at least two of the shafts of the plurality of posts adapted to be positioned in the plurality of pre-selected bores of the coaster have different longitudinal lengths to further compensate for irregularities in the flooring.

67. A kit as defined in claim 56, wherein the shaft of the each of the plurality of posts has substantially the same diameter throughout the longitudinal extent between the proximal head and the distal tip.

68. A furniture support and carpet protection apparatus kit for supporting furniture and reducing damage to an underlying carpet, the kit comprising:

a container;

a plurality of posts positioned in the container and each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster positioned in the container and adapted to be positioned under the furniture structural member, the coaster having a coaster body, an upper surface, a lower surface, and a plurality of bores extending through the coaster body from the upper surface to the lower surface, each of the bores adapted to have one of the posts positioned therein and extend therethrough;

a coaster cover positioned in the container and having a coaster cover body, an upper surface adapted to be positioned to underlie the furniture structural member, and a lower surface adapted to be positioned to overlie the coaster, the coaster cover providing mount support to the furniture structural member when positioned to overlie the carpet so that the coaster cover distributes the weight of the furniture structural member to the proximal head of each of the plurality of posts; and a coaster cover lower mattress positioned in the container and adapted to be positioned between the upper surface of the coaster and the lower surface of the coaster cover, to abuttingly contact each proximal head of the plurality of posts and being compressible by the weight of the furniture structural member when positioned on the coaster cover to further compensate for differing longitudinal positions of the proximal heads of the plurality of posts when sliding through the plurality of bores of the coaster, wherein the coaster cover lower mattress further restricts lateral displacement of the coaster cover with respect to the coaster and provides a cushioned interface for the lower surface of the coaster cover.

69. A kit as defined in claim 68, wherein the carpet overlies the flooring and comprises a carpet pile, a backing connected to and underlying the carpet pile, and a carpet pad positioned to underlie the backing and to overlie an upper surface of flooring, and wherein each of the distal tips of the plurality of posts are shaped to extend through and to contact the upper surface of flooring.

70. A kit as defined in claim 68, wherein the coaster cover further includes a plurality of sides forming a lateral periphery substantially perpendicular to the furniture structural member, wherein at least one of the plurality of sides includes a flange protruding from at least one of the sides and positioned to restrict lateral displacement of the furniture structural support with respect to the coaster cover, when the coaster cover is positioned thereunder.

71. A furniture support and carpet protection apparatus kit for supporting furniture and reducing damage to an underlying carpet, the kit comprising:

a container;

a plurality of posts positioned in the container and each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster positioned in the container and adapted to be positioned under the furniture structural member, the coaster having a coaster body, an upper surface, a lower surface, and a plurality of bores extending through the coaster body from the upper surface to the lower surface, each of the bores adapted to have one of the posts positioned therein and extend therethrough;

a coaster cover positioned in the container and having a coaster cover body, an upper surface adapted to be positioned to underlie the furniture structural member, and a lower surface adapted to be positioned to overlie the coaster, the coaster cover providing mount support to the furniture structural member when positioned to overlie the carpet so that the coaster cover distributes the weight of the furniture structural member to the proximal head of each of the plurality of posts;

a coaster cover plate positioned in the container and having an upper surface adapted to underlie the coaster cover and a lower surface overlying the coaster, and wherein at least one of the coaster cover and the coaster cover plate includes magnetic material and at least one of the coaster cover and the coaster cover plate includes magnetically responsive material to restrict movement of the coaster cover with respect to the coaster.

72. A furniture support and carpet protection apparatus kit for supporting furniture and reducing damage to an underlying carpet, the kit comprising:

a container;

a plurality of posts positioned in the container and each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster positioned in the container and adapted to be positioned under the furniture structural member, the coaster having a coaster body, an upper surface, a lower surface, and a plurality of bores extending through the coaster body from the upper surface to the lower surface, each of the bores adapted to have one of the posts positioned therein and extend therethrough; and a coaster cover positioned in the container and having a coaster cover body, an upper surface adapted to be positioned to underlie the furniture structural member, and a lower surface adapted to be positioned to overlie the coaster, the coaster cover providing mount support to the furniture structural member when positioned to overlie the carpet so that the coaster cover distributes the weight of the furniture structural member to the proximal head of each of the plurality of posts, the coaster cover body of the coaster cover having an annular flange protruding outwardly from both the upper and lower periphery of the coaster cover body to restrict lateral displacement of the coaster cover with respect to the coaster and to restrict lateral displacement of the furniture structural support with respect to the coaster cover, when positioned therebetween.

73. A furniture support and carpet protection apparatus kit for supporting furniture and reducing damage to an underlying carpet, the kit comprising:

a container;

a plurality of posts positioned in the container and each including a shaft of a pre-selected length and having a first end and a second end, the first end of the shaft defining a proximal head of the post and the second end of the shaft defining a distal tip of the post shaped to penetrate the carpet when under the weight of a furniture structural member;

a coaster positioned in the container and adapted to be positioned under the furniture structural member, the coaster having a coaster body, an upper surface, a lower surface, and a plurality of bores extending through the coaster body from the upper surface to the lower surface, each of the bores adapted to have one of the posts positioned therein and extend therethrough;

a coaster cover positioned in the container and having a coaster cover body, an upper surface adapted to be positioned to underlie the furniture structural member, and a lower surface adapted to be positioned to overlie the coaster, the coaster cover providing mount support to the furniture structural member when positioned to overlie the carpet so that the coaster cover distributes the weight of the furniture structural member to the proximal head of each of plurality of posts; and a floor plate adapted to be positioned to underlie the carpet and to overlie flooring to support the distal tips of the plurality of posts when positioned under the weight of the furniture structural member to reduce damage to the flooring.

74. A kit as defined in claim 73, wherein the coaster cover further includes a plurality of sides forming a lateral periphery substantially perpendicular to the furniture structural member, wherein at least one of the plurality of sides includes a flange protruding from the at least one of the sides and positioned to restrict lateral displacement of the furniture structural support with respect to the coaster cover and positioned to restrict lateral displacement of the coaster cover with respect to the coaster, when the coaster cover is positioned thereunder.

75. A method of using a furniture support and carpet protection apparatus for supporting furniture and reducing damage to a carpet, the method comprising the steps of:

(a) positioning a coaster on a selected piece of carpet, the coaster having a coaster body, an upper surface, a lower surface, and a plurality of bores extending through the coaster body from the upper surface to the lower surface;

(b) positioning a plurality of posts through a like number of bores in the coaster;

(c) selectively adjusting a length of a subset of the plurality of posts less than a total number of the plurality of posts to compensate for any substantial irregularities underlying carpet encountered by the subset of the plurality of posts; and (d) connecting a coaster cover plate to the coaster adjacent the upper surface of the coaster, and placing the coaster cover plate in abutting contact with at least two proximal heads of the plurality of posts.

76. A method of using a furniture support and carpet protection apparatus for supporting furniture and reducing damage to a carpet, the method comprising the steps of:

(a) positioning a coaster on a selected piece of carpet, the coaster having a coaster body, an upper surface, a lower surface, and a plurality of bores extending through the coaster body from the upper surface to the lower surface;

(b) positioning a plurality of posts through the bores in the coaster, a length of each of the posts being selected dependent upon the combined height of a carpet and any irregularities on the surface beneath the carpet;

(c) selectively adjusting the length of a subset of the plurality of posts to compensate for an irregularity greater than at minimum the thickness of a coaster cover lower mattress, positioned between the coaster and a coaster cover; and (d) positioning a coaster cover adjacent the upper surface of the coaster, and placing at least one of the coaster cover and the coaster cover lower mattress abutting at least two proximal heads of the plurality of posts.

77. A method of using a furniture support and carpet protection apparatus for supporting furniture and reducing damage to a carpet, the method comprising the steps of:

(a) positioning a coaster on a selected niece of carpet the coaster having a coaster body, an upper surface, a lower surface, and a plurality of bores extending through the coaster body from the upper surface to the lower surface;

(b) positioning a plurality of posts through the bores in the coaster, each of the plurality of posts having a shaft of a pre-selected length, a proximal head and a distal tip, the number of posts being positioned through the bores being dependent upon a weight bearing load carried by a furniture structural member, the length of each of the posts being selected dependent upon the combined height of a carpet;

(c) connecting a coaster cover plate to the coaster adjacent the upper surface of the coaster, and placing the coaster cover plate in abutting contact with at least two proximal heads of the plurality of posts;

(d) covering the coaster, coaster cover plate, and the plurality of posts with a coaster cover having an upper surface and a lower surface, the coaster cover providing mount support to the furniture structural member when positioned to overlie the carpet; and (e) positioning the furniture structural member atop the upper surface of the coaster cover.

78. A method of using a furniture support and carpet protection apparatus for supporting furniture and reducing damage to a carpet, the method comprising the steps of:

(a) positioning a coaster on a selected piece of carpet, the coaster having a coaster body, an upper surface, a lower surface, and a plurality of bores extending through the coaster body from the upper surface to the lower surface;

(b) positioning a plurality of posts through the bores in the coaster, each of the plurality of posts having a shaft of a pre-selected length, a proximal head and a distal tip, the number of posts being positioned through the bores being dependent upon a weight bearing load carried by a furniture structural member, the length of each of the posts being selected dependent upon the combined height of a carpet;

(c) selectively adjusting the length of a subset of the plurality of posts to compensate for an irregularity greater than at minimum the thickness of at least one of a first mattress of a coaster cover plate and a coaster cover lower mattress, positioned between the coaster and a coaster cover;

(d) covering the coaster and the plurality of posts with the coaster cover to provide mount support to the furniture structural member when positioned to overlie the carpet; and (e) positioning the furniture structural member atop the upper surface of the coaster cover.

* * * * *